US006370839B1

(12) United States Patent
Nakagawa et al.

(10) Patent No.: US 6,370,839 B1
(45) Date of Patent: Apr. 16, 2002

(54) STRETCH WRAPPING MACHINE

(75) Inventors: Kinta Nakagawa, Osaka; Tomotoshi Ohya, Ishikawa; Yoshimi Ogita, Ishikawa; Toshiro Ohira, Ishikawa; Nobuyuki Takasugi, Ishikawa, all of (JP)

(73) Assignee: Sekisui Jushi Kabushiki Kaisha, Osaka (JP)

( * ) Notice: Subject to any disclaimer, the term of this patent is extended or adjusted under 35 U.S.C. 154(b) by 0 days.

(21) Appl. No.: 09/635,230

(22) Filed: Aug. 9, 2000

(30) Foreign Application Priority Data

| | | |
|---|---|---|
| Aug. 10, 1999 | (JP) | 11-225891 |
| Sep. 1, 1999 | (JP) | 11-247694 |
| Nov. 30, 1999 | (JP) | 11-340203 |
| Feb. 10, 2000 | (JP) | 2000-033669 |

(51) Int. Cl.[7] ..... B65B 57/02
(52) U.S. Cl. ..... 53/64; 52/211
(58) Field of Search ..... 53/21, 52, 64, 53/209, 211, 212, 509; 714/47, 723, 799

(56) References Cited

U.S. PATENT DOCUMENTS

| | | | | |
|---|---|---|---|---|
| 3,712,020 A | * | 1/1973 | Norr et al. | 53/209 |
| 4,077,179 A | * | 3/1978 | Lancaster et al. | 53/211 |
| 4,248,031 A | | 2/1981 | Del Pozo, Jr. | |
| 4,706,443 A | | 11/1987 | Humphrey | |
| 4,914,358 A | * | 4/1990 | Nakamura | 315/173 |
| 5,189,732 A | * | 2/1993 | Kondo | 345/173 |
| 5,537,798 A | | 7/1996 | Fukuda et al. | |
| 5,749,206 A | | 5/1998 | Moore et al. | |

FOREIGN PATENT DOCUMENTS

| | | |
|---|---|---|
| EP | 0 096 635 A2 | 12/1983 |
| EP | 0 822 473 A2 | 2/1998 |

* cited by examiner

*Primary Examiner*—Rinaldi I. Rada
*Assistant Examiner*—Nathaniel Chukwurah
(74) *Attorney, Agent, or Firm*—Rader, Fishman & Grauer PLLC

(57) ABSTRACT

The stretch wrapping machine employs a touch panel input device as input means for setting the film wrapping data into the controller, and the display of the touch panel input device provides digital presentation of the information on set values of the film wrapping data or a machine failure. Wrapping conditions (e.g. feed rate of the feed mechanism, control amount of the feed roller, rotation ratio of the feed roller to a stretch roller) can be automatically computed simply by entering film wrapping data on the number of wraps on the load, the film overlap amount, the film wrapping tension or the film stretch ratio, etc. The film wrapping operation is performed based on the computated conditions. The wrapping machine further comprises a load detection unit for detecting a load which is imposed on a film fed out from the feed roller onto an article. While constantly computing a difference between a measured value of the wrapping tension deriving from the detected value of the load and a set value of the wrapping tension as set by the input means, the number of feed roller rotations is feedback controlled in such a manner as to decrease the difference to zero.

18 Claims, 21 Drawing Sheets

Fig.12

401

Emergency stop

Buzzer stop

Failure reset

The emergency stop button on the panel is pressed.

Release the lock by turning the button clockwise.

Fig.13

402

Carriage descent failure

Drawing

Photograph

Buzzer stop

Failure reset

1) Check if the lower limit switch is activated. Remove an obstacle.

2) Check if the carriage has reached the floor.

3) Check if the wiring for the limit switch is disconnected.

Further information

Device monitor

Fig.14

403

Carriage upper/lower limit sensors failure | Drawing | Photograph

Buzzer stop | Failure reset

The upper and lower limit switches are both ON at the same time.

1) Check if the lever touches anything. Make sure the lever is secured tightly.
2) Check if the wiring of the sensors is disconnected.

Further information | Device monitor

Fig.15

404

Turntable sensors failure | Drawing | Photograph

Buzzer stop | Failure reset

The proximity sensor below the turntable is not working.

1) Check if the wiring of the sensor is disconnected.
2) Check if the sensor is fixed at a proper position.
(Is the sensor fixed within the detection range?)

Further information | Device monitor

Fig.26

325

Automatic / Manual / Setting / Data / Quantity / Ver.

Program total 50

| | |
|---|---|
| Program P21 | 10 products |
| Program P22 | 10 products |
| Program P23 | 10 products |
| Program P24 | 10 products |
| Program P25 | 10 products |

Fig.27

421

Emergency stop

Buzzer stop

Failure reset

The emergency stop button on the panel is pressed.

Release the lock by turning the button clockwise.

Fig.28

422

Drum sensor failure | Drawing | Photograph

Buzzer stop | Failure reset

The proximity sensor below the drum is not working.

1) Check if the wiring of the sensor is disconnected.

2) Check if the sensor is fixed at a proper position.
(Is the sensor located in the detection range?)

Further information | Device monitor

Fig.29

423

Drum inverter failure

Buzzer stop | Failure reset

Stopped due to the protective function of the inverter

1) See the monitor indication of the inverter.

2) In case the problem is not solved by pressing the reset button of the inverter, contact the dealer of your purchase.

Inverter monitor

STRETCH WRAPPING MACHINE

BACKGROUND OF THE INVENTION

The present invention relates to a stretch wrapping machine for wrapping a plurality of loads placed on a pallet with a plastic film in a stretched state.

For distribution and sale, products are often packed in a small unit in cartons or the like, and a certain number of packets (loads) are loaded on a pallet for shipping, cargo handling and storage.

Nevertheless, the loads on a pallet are likely to fall out of arrangement during shipping, cargo handling, storage, etc. Besides, product values may deteriorate during shipping, etc., because the pallet load may get wet by rain or the like or smeared with something like dirt. Further, some of the loads can be stolen during storage, etc.

Recently, in order to prevent palletized loads from falling out of shape and to protect them from rain, dirt, steal, etc., a polyethylene or other plastic film is wrapped around a plurality of palletized loads to provide so-called stretch wrapping.

As the stretch wrapping apparatus, there have been proposed some types of stretch wrapping machines. A turntable type stretch wrapping machine comprises a turntable for mounting a load, a carriage equipped with a feed roller for feeding a film, a mast for holding the carriage, and an elevator mechanism for raising and lowering the carriage along the mast. With a film roll set on the carriage and a pallet load placed on the turntable, the wrapping machine feeds a film along lateral surfaces of the pallet load by turning the turntable and moving the carriage upwards and downwards, so that the film is spirally wrapped around the pallet load [e.g. Japanese Patent Application Publication No. S59-9403 (JP-B-9403/1984)].

A rotary arm type stretch wrapping machine comprises a fixed table for mounting a load, a carriage equipped with a feed roller for feeding a film, an arm for revolving the carriage a round lateral surfaces of the pallet load, and an elevator mechanism for raising and lowering the carriage. With a pallet load placed on the fixed table, the wrapping machine feeds a film along lateral surfaces of the pallet load by turning the carriage around the lateral surfaces of the load and moving the carriage upwards and downwards, so that the film is spirally wrapped around the pallet load [e.g. Japanese Patent Application Laid-Open No. H8-156908 (JP-A-156908/1996)].

A rotary drum type stretch wrapping machine comprises a conveyor for carrying a long load, a carriage equipped with a feed roller for feeding a film, and a drum for rotating the carriage around lateral surfaces of the long load. With the leading end of the long load placed inside the drum, the wrapping machine feeds a film by rotating the drum while allowing the conveyor to feed the load at a fixed rate, so that the film is spirally wrapped around the long load.

Additionally, these types of stretch wrapping machine may apply a prestretch system. Such wrapping machine further comprises a stretch roller disposed opposite to a feed roller, so that a film is wrapped around a load in a prestretched state.

In the case of conventional stretch wrapping machines, operators have to perform analog volume controls in order to set various operational values such as the number of rotations of the rotation mechanism (e.g. number of turntable rotations), the feed rate of the feeding mechanism (e.g. carriage feed rate), the number of rotations of the feed roll, etc. Inevitably, the set values are heavily dependent on every operator's sense and variable from one operation to the other. Hence, it is difficult to maintain constantly good film wrapping conditions.

Besides, operators have to put considerable time in computing control amounts such as the number of rotations of the rotation mechanism, the feed rate of the feeding mechanism, the amount of film feed, etc. based on the data related to film wrapping such as film overlap amount and film wrapping tension.

In the case of the turntable type stretch wrapping machine, when the plane geometry of the load to be wrapped is square or rectangular, the film feed amount demanded on the load side (hereinafter referred to as the film feed demand) varies during the film wrapping process. By way of illustration, as shown in FIG. 31, when a corner 9*c* of a load 9 is rotationally displaced from a position near a film feeder 500 as shown in FIG. 31(A) to a position shown in FIG. 31(B), the film feed demand increases along with the rotational displacement. Similar variation of the film feed demand happens in the rotary arm type stretch wrapping machine.

Where the film feed demand varies, if the feed roller rotates at a fixed speed, the tension of the film fed onto a load changes in accordance with the film feed demand. As a result, the film cannot be wrapped around the load at an even tension. Besides, because of the tension change, a film may be tensioned at a corner of the load so strongly as to be torn. Otherwise, excessive film tension may damage the corner of the load or cause the pallet load to fall out of shape.

As described above, the film feed demand varies where a pallet load has a square or rectangular plane geometry. In addition, such variation may occur due to the kinds of loads, the loading conditions, etc.

From another aspect, when a failure occurs during operation, prior art stretch wrapping machines are designed to warn an operator of the failure by flashing a lamp or the like which indicates the type of failure. Upon noticing the failure, the operator performs a recovery procedure either by looking into the manuals, etc. for a proper operation corresponding to the lamp indication or by contacting a manufacturer for instructions.

Such conventional troubleshooting procedure is troublesome and time-consuming in discovering the proper recovery operation and eventually solving the problem. When the operator has to make contact with a manufacturer to solve the problem, generally by telephone, the operator often finds difficulty in explaining the exact state of the failure to the manufacturer, and has to wait for a long time before a person in charge of maintenance can give him a proper direction.

SUMMARY OF THE INVENTION

In a stretch wrapping machine which comprises a carriage for mounting a film roll, a rotation mechanism for producing relative rotation between the carriage and an article to be wrapped, a feed mechanism for displacing the carriage relative to the article, and a controller for controlling a drive for each of the rotation mechanism and the feed mechanism, and which is arranged to feed a film to the article by providing relative rotation between the film roll-mounted carriage and the article and to wrap the film around the article by displacing the carriage relative to the article, the present invention intends to ensure constantly good film wrapping conditions for various loads, regardless of the type, shape, etc.

To achieve this object, the present invention provides a touch panel input device for setting film wrapping data into the controller and allows the touch panel input device to provide digital presentation of the set data.

In the stretch wrapping machine of this invention, the data set by the touch panel input device relate to the number of rotations of the rotation mechanism (e.g. number of turntable rotations), a film overlap amount, a film wrapping tension, and the like.

Thus, the stretch wrapping machine of this invention allows the display of the touch panel input device to provide digital presentation (e.g. digital numeric value) of set values such as the number of rotations of the rotation mechanism, the overlap amount, the film wrapping tension and the like. Therefore, any operator can easily set or switch the wrapping conditions to the same values, without personal differences. As a result, good wrapping conditions can be constantly ensured.

Besides, the touch panel input device may have a function of displaying a screen for selecting any one of a plurality of programs which are set and stored in advance.

Further, the touch panel input device may have a function of selectively displaying any one of a plurality of screens in response to a touch input, the screens including a setting screen for setting data on the number of rotations of the rotation mechanism, any one of a film overlap amount and a feed rate of the feed mechanism, and a film wrapping tension, an automatic operation screen for indicating a condition of an automatic operation and a manual operation screen for conducting a manual operation.

In addition, the controller may be arranged to monitor an occurrence of a machine failure, and, in the case of a failure, to indicate a failure point and failure details on a display of the touch panel input device.

Also, the controller may be arranged to monitor an occurrence of a machine failure, and, in the case of a failure, to supply information on a failure point and failure details to an output unit, so that the failure information can be sent from the output unit to a person in charge of maintenance via a communication network.

In a stretch wrapping machine which comprises a carriage mounted with a feed roller for feeding a film from a film roll, a rotation mechanism for providing relative rotation between the carriage and an article to be wrapped, a feed mechanism for displacing the carriage relative to the article, and a controller for controlling a drive for each of the rotation mechanism, the feed roller and the feed mechanism, and which is arranged to feed a film to the article by providing relative rotation between the film roll-mounted carriage and the article and to wrap the film around the article by displacing the carriage relative to the article, the present invention intends to ensure constantly good film wrapping conditions for various loads, regardless of the type, shape, etc.

To achieve this object, the present invention provides an input unit for setting film wrapping data into the controller. A feed rate of the feed mechanism is computed by using a set value of the number of rotations of the rotation mechanism and a set value of the film overlap amount as set by the input unit, and the computed feed rate is utilized for controlling the drive for the feed mechanism. A control amount of the feed roller is computed by using any one of a detected value of the wrapping tension and a detected value of the number of rotations of the feed roller and also using a set value of the wrapping tension as set by the input unit, and the computed control amount is utilized for controlling the drive for the feed roller.

In this stretch wrapping machine, the controller may be arranged to compute a feed rate of the feed mechanism by using a set value of the number of rotations of the rotation mechanism and a set value of a film overlap amount as set by the input unit, and to control a drive for the feed mechanism based on the computed feed rate.

In this stretch wrapping machine, the input unit may be a touch panel input device, and a display of the touch panel input device may be arranged to provide digital presentation of the set data.

In operating the stretch wrapping machine of this invention, an operator only needs to input values for the number of rotations of the rotation mechanism, the overlap amount, the film wrapping tension, etc. Accordingly, the stretch wrapping machine performs a film wrapping operation, automatically computing the feed rate of the carriage, the control amount of the feed roller (the film feed amount) and the like. Since such wrapping operation is not affected by personal differences, any operator can achieve constantly good wrapping conditions.

The stretch wrapping machine of this invention may be arranged to detect a load which is imposed on a film fed out from the feed roller to the article to be wrapped, and to constantly compute a difference between a measured value of the wrapping tension deriving from the detected value of a load and a set value of the wrapping tension as set by the input unit, thereby feedback-controlling the number of rotations of the feed roller in such a manner as to decrease the computed difference to zero.

The unit for detecting the load imposed on a film may be a load cell.

According to this arrangement, when the film feed demand varies during a film wrapping operation, the number of rotations of the feed roller is adjusted in correspondence with the varied amount. Consequently, the film wrapping tension is kept at an even level to render the film more resistant to rupture. As the load detection unit, a load cell is preferable because of its ability to detect the load (tension) imposed on the film directly and accurately as well as its simple structure.

If the stretch wrapping machine of this invention applies a prestretch system, a stretch roller is disposed opposite to the feed roller. The rotation ratio of the feed roller to the stretch roller is computed by using a set value of the stretch ratio as set by the input unit. Based on the computed rotation ratio, the number of rotations of the stretch roller is controlled.

If the feed mechanism is an elevator mechanism which displaces the carriage in upward and downward directions, the stretch wrapping machine of this invention may further comprise a top end detection unit for detecting a top end of the article. In this case, the stretch wrapping machine may be arranged to compute an upper limit of an upward travel of the carriage by using an output of the top end detection unit and a set value of an amount of top fold as set by the input unit, then to obtain a time for the carriage to reach the upper limit by using the computed upper limit and a computed value of an up-down speed of the carriage, and thereby to control the upper limit of the upward travel of the carriage.

In each stretch wrapping machine according to the above inventions, the touch panel input device may have a function of displaying a screen for selecting any one of a plurality of programs which are set and stored in advance. Accordingly, it is possible to set and store programs for performing film wrapping of a plurality of types of pallet loads in various shapes, sizes, etc. When the load subjected to film wrapping is to be changed, the wrapping conditions can be automatically switched to the conditions for a new load simply by selecting a program suitable for the new load.

The touch panel input device may have a function of selectively displaying any one of a plurality of screens in response to a touch input, the screens including a setting screen for setting data on the number of rotations of the rotation mechanism, a film overlap amount and a film wrapping tension, an automatic operation screen for indicating a condition of an automatic operation, and a manual operation screen for conducting a manual operation. This arrangement further improves the operability in the setting operation.

The stretch wrapping machine according to each of the above inventions may be arranged to monitor an occurrence of a machine failure, and, in the case of a failure, to indicate a failure point and failure details on a display of the touch panel input device. Owing to this arrangement, when a failure breaks out, an operator can easily and clearly understand the state of the failure simply by looking at the screen on the display of the touch panel input device.

The stretch wrapping machine according to each of the above inventions may be arranged to monitor an occurrence of a machine failure, and, in the case of a failure, to supply information on a failure point and failure details to an output unit, so that the failure information can be sent from the output unit to a person in charge of maintenance via a communication network. Owing to this arrangement, the failure information is directly reported to the manufacturer side, instead of being informed by an operator. Therefore, even if the operator is not familiar with the structure and operation of every part of the stretch wrapping machine, the manufacturer can understand the exact state of the failure.

BRIEF DESCRIPTION OF THE DRAWINGS

FIG. 12 to FIG. 16 illustrate examples of failure indication screens.

FIG. 22 to FIG. 26 illustrate examples of screens shown on a display of a touch panel input device.

FIG. 27 to FIG. 29 illustrate examples of failure indication screens.

DETAILED DESCRIPTION OF THE INVENTION

Preferred embodiments of the present invention are hereinafter described in detail, with reference to the drawings.

Figure 1:
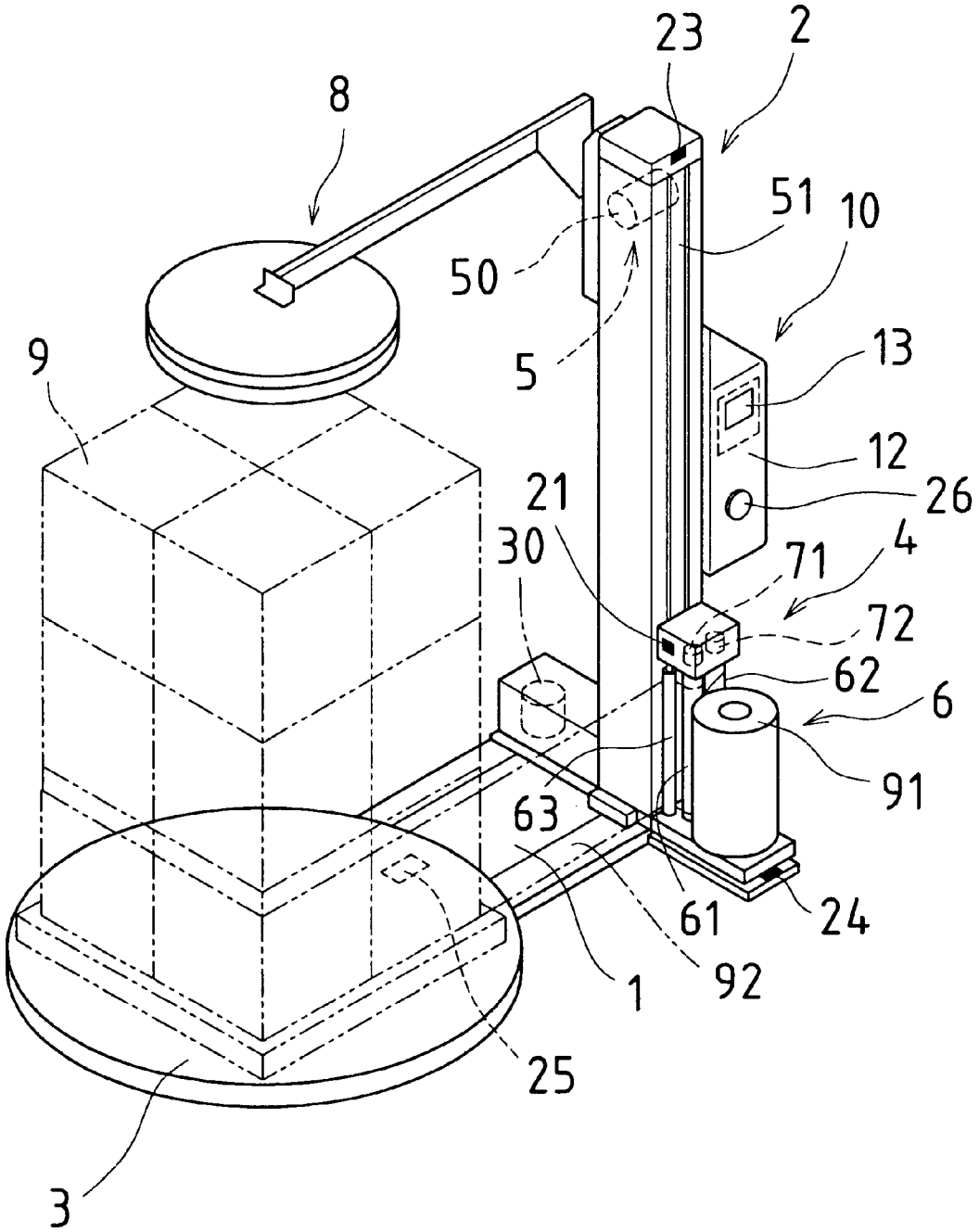
FIG. 1 is a perspective view schematically showing the overall structure of an embodiment of a turntable type stretch wrapping machine according to the present invention.

FIG. 1 shows an embodiment of a turntable type stretch wrapping machine according to the present invention.

The stretch wrapping machine of this embodiment principally comprises a base frame 1, a mast 2 having its bottom end fixed on the base frame 1, a turntable 3, a carriage 4, an elevator mechanism 5, a film feeder 6 and a control box 10. The panel of the control box 10 includes a touch panel input device 12 having a display 13. In the stretch wrapping machine shown in FIG. 1, a platen 8 is provided at the top of the mast 2 for the purpose of preventing a load 9 from falling out of shape while the load 9 placed on the turntable 3 is rotated.

The turntable 3 is rotatably held at the tip end of the base frame 1. The turntable 3 is rotated by a turntable rotation motor 30 located at an end of the base frame 1 on the mast 2 side.

The carriage 4 is held by the mast 2 in a vertically movable manner and displaced upwards and downwards by means of the elevator mechanism 5. The elevator mechanism 5 comprises a carriage up-down motor 50 and a belt 51 entrained about the rotation shaft of the motor 50 via a pulley (not shown) or the like. The rotation of the carriage up-down motor 50 moves the belt 51 up and down, thereby to raise and lower the carriage 4.

A photoelectric switch 21 is disposed at the top of the carriage 4 for detecting the load 9 placed on the turntable 3. While the carriage 4 rises from the lower limit (original position), the photoelectric switch 21 remains turned on as long as the detection light catches the load 9. When the detection light misses the load 9, i.e. when the photoelectric switch 21 locates above the top end of the load 9, the switch 21 is turned off.

Figure 2:
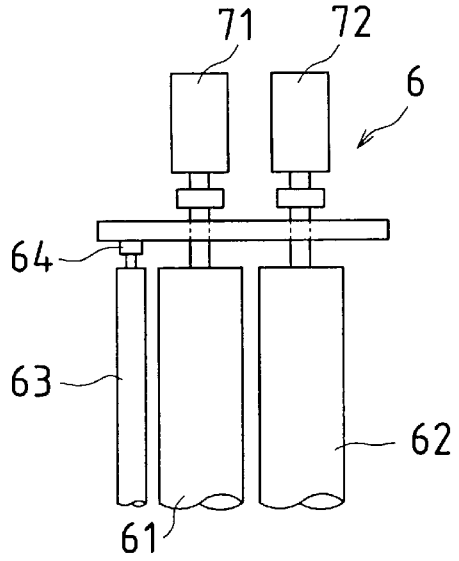
FIG. 2 is a front view of a film feeder used in the stretch wrapping machine of FIG. 1.
Figure 3:
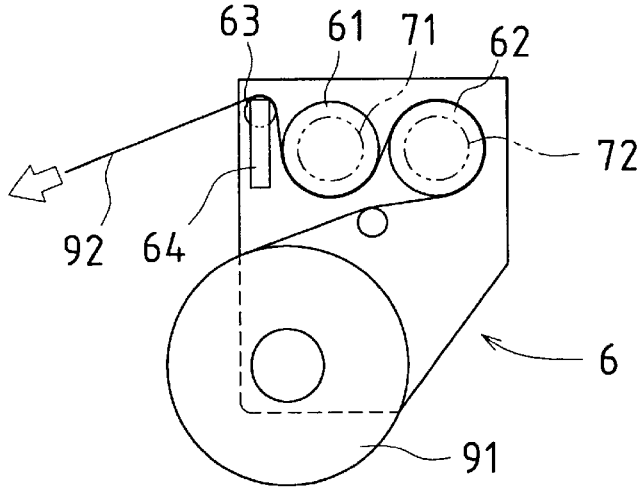
FIG. 3 is a plan view schematically showing the structure of the film feeder.
Figure 4:
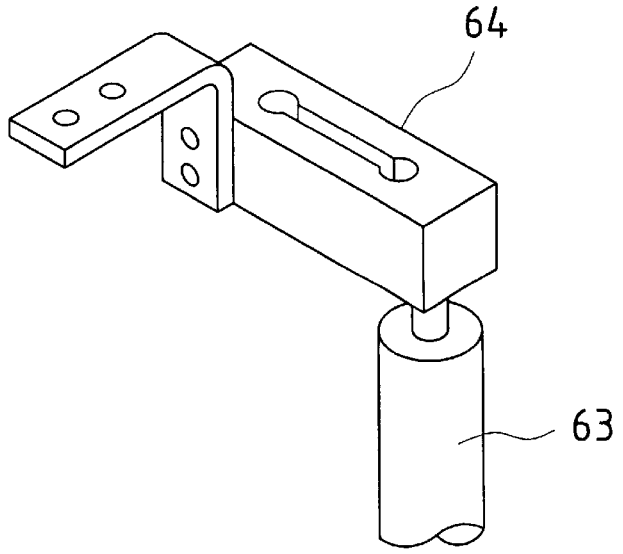
FIG. 4 is a perspective view schematically showing the structure of holding a guide roller.

The film feeder 6 is mounted on the carriage 4 and provided with three rollers, feed roller 61, stretch roller 62 and guide roller 63 (non-driven roller), as shown in FIG. 2 to FIG. 4. The guide roller 63 is rotatably held by an arm 64.

The feed roller 61 and the stretch roller 62 are rotated by a film feed motor 71 and a film stretch roller 72, respectively. The number of rotations of the film stretch motor 72 is controlled with respect to that of the film feed motor 71, such that a film 92 is fed out in a prestretched state.

Referring to FIG. 3, in the above film feeder 6, a film 92 drawn out from a film roll 91 is allowed to weave its way between the stretch roller 62 and the feed roller 61, to pass along the feed roller 61 and the guide roller 63, and finally to be fed onto lateral surfaces of the load 9 placed on the turntable 3.

Since the guide roller 63 is held by a load cell 64, the load cell 64 can directly detect the force exerted on the guide roller 63, i.e. a load (tension) imposed on the film 92 fed onto the load 9 (article). The output from the load cell 64 serves to provide numerical (digital) information of the tension imposed on the film 92.

Above and below the carriage 4, there are limit switches 23, 24 for preventing the carriage 4 from travelling beyond the upper limit and the lower limit. In addition, a proximity sensor 25 is provided below the turntable 3 in order to detect the original position (rotation direction) of the turntable 3.

Figure 5:
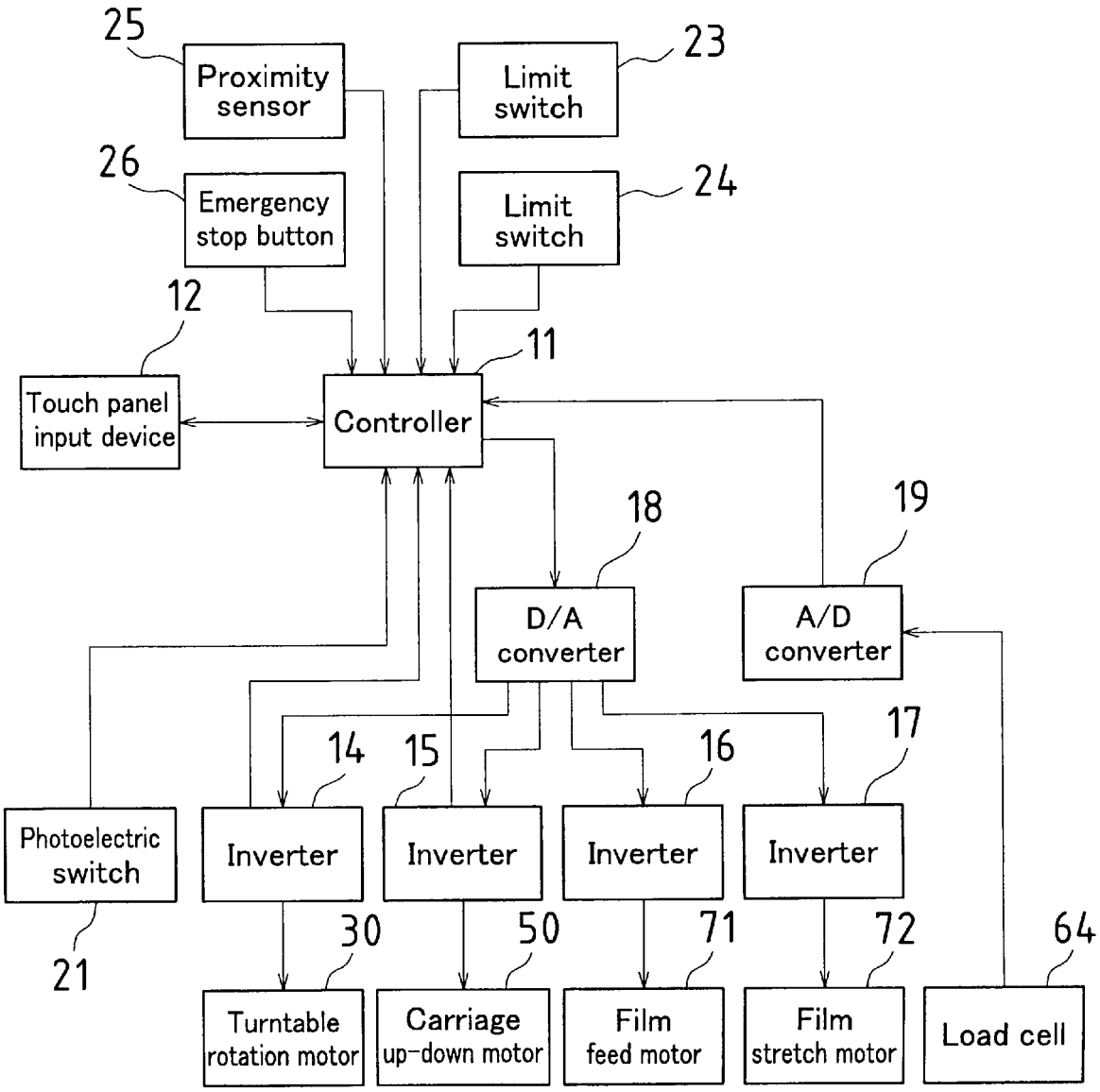
FIG. 5 is a block diagram showing the structure of a control system in the stretch wrapping machine of FIG. 1.

Now, the structure of the control system of this embodiment is described with reference to the block diagram of FIG. 5 and FIG. 1 above.

The control system of this embodiment comprises a controller 11 and a touch panel input device 12 for setting the wrapping condition data in the controller 11.

The controller 11 supplies control signals via a D/A converter 18 to inverters 14, 15, 16, 17 connected to the turntable rotation motor 30, the carriage up-down motor 50, the film feed motor 71 and the film stretch roller 72, respectively.

The controller 11 receives outputs from the photoelectric switch 21 equipped on the carriage 4, from the two limit switches 23, 24 located above and below the carriage 4 and from the proximity sensor 25 disposed below the turntable 3. The controller 11 also receives, via an A/D converter 19, an output from the load cell 64 disposed in the film feeder 6.

The inverters 14, 15 respectively connected to the turntable rotation motor 30 and the carriage up-down motor 50 have a protective function. When the protective function is activated, a failure signal is transmitted to an external device, and the failure details which triggered the protective function are displayed on an operation panel (on the inverter side). The failure signals from the inverters 14, 15 are supplied to the controller 11.

As shown in FIG. 6 to FIG. 10, the touch panel input device 12 allows the display 13 to selectively display any of an automatic operation screen 301, a manual operation screen 302, a setting screen 303, a data indication screen 304 and a quantity indication screen 305. The screen can be selected by touching, with a finger, any of the indexes marked "Automatic", "Manual", "Setting", "Data" and "Quantity" at the top of the screens 301, 302, 303, 304, 305. The panel of the touch panel input device 12 (the control box 10) also includes an emergency stop button 26 (FIG. 1).

Figure 6:
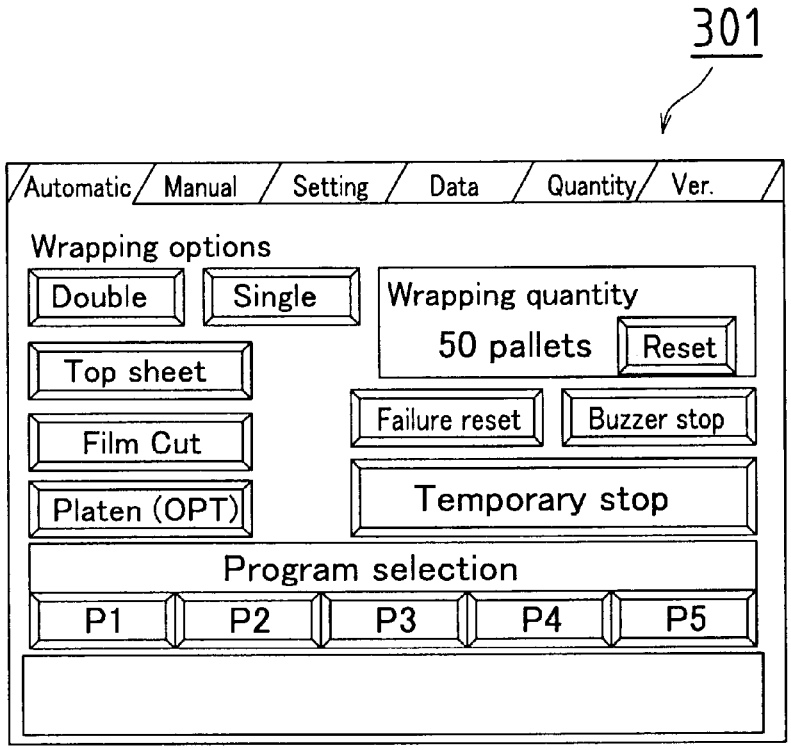
FIG. 6 to FIG. 10 illustrate examples of screens shown on a display of a touch panel input device.

As shown in FIG. 6, the automatic operation screen 301 displays input keys for setting wrapping options, such as wrapping mode (double wrap/single wrap), top sheet, film cut and use of platen, and wrapping quantity, as well as program selection keys for selecting any of programs P1 to P5 to be mentioned below.

Figure 7:
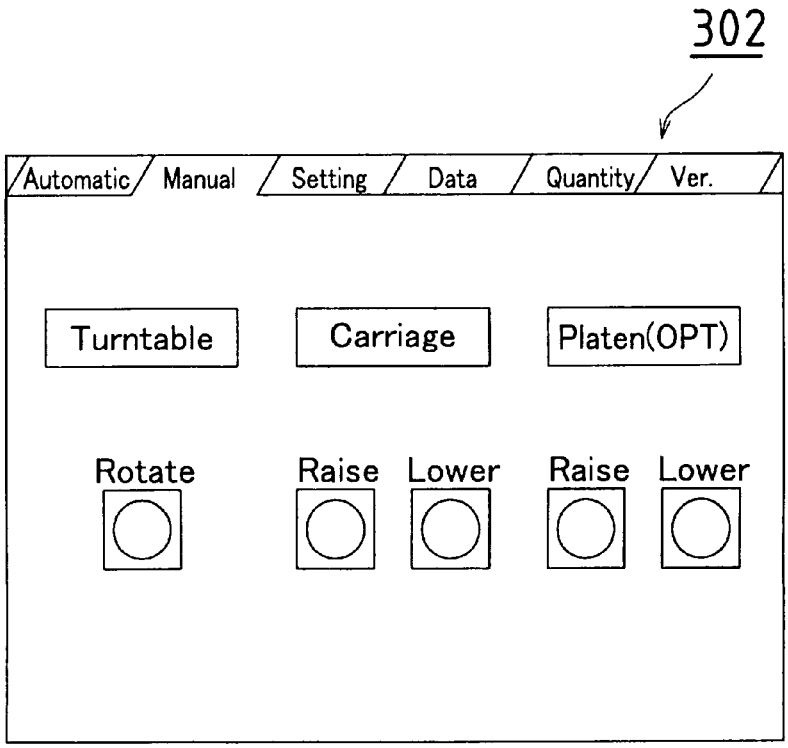

As shown in FIG. 7, the manual operation screen 302 displays a manual operation button for rotating the turntable 3 and manual operation buttons for raising and lowering the carriage 4 and the platen 8.

Figure 8:
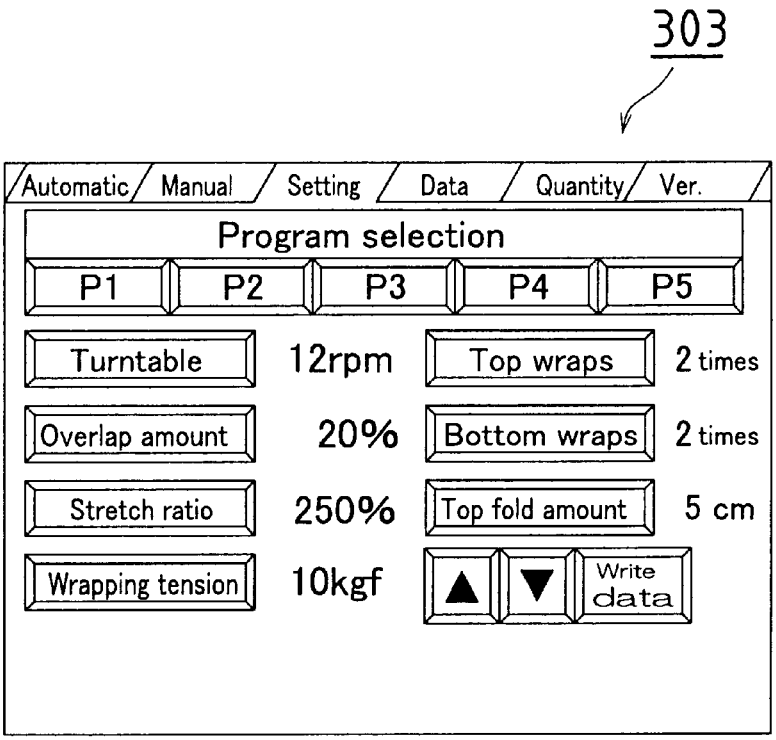

As shown in FIG. 8, the setting screen 303 displays item designation keys for designating an item to be set (e.g. number of turntable rotations, overlap amount, stretch ratio, wrapping tension, number of top wraps, number of bottom wraps, amount of top fold), UP/DOWN keys for the input of numerical values for each item to be set, and program selection keys for selecting any of programs P1 to P5. This setting screen 303 provides digital (numerical) presentation of the set value of each item, and allows each value to be entered by the operation of the UP/DOWN keys. After the values of all items are entered, the set data can be stored by pressing a "Write data" key, followed by one of the program selection keys. Up to five types of set data can be stored in this manner.

In this embodiment, the possible numerical value ranges for each item are 6 to 12 rpm for the number of turntable rotations, −10 to 40% for the overlap amount, 0 to 250% for the stretch ratio, 2 to 20 kgf for the wrapping tension, 0 to 9 times for the top wraps, 0 to 9 times for the bottom wraps and 0 to 15 cm for the top fold amount.

Figure 9:
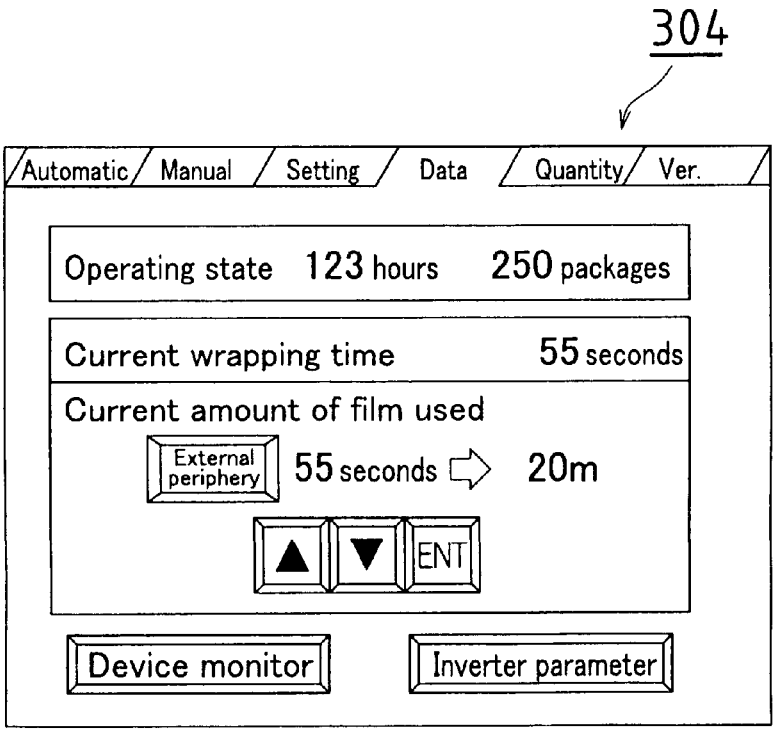
Figure 10:
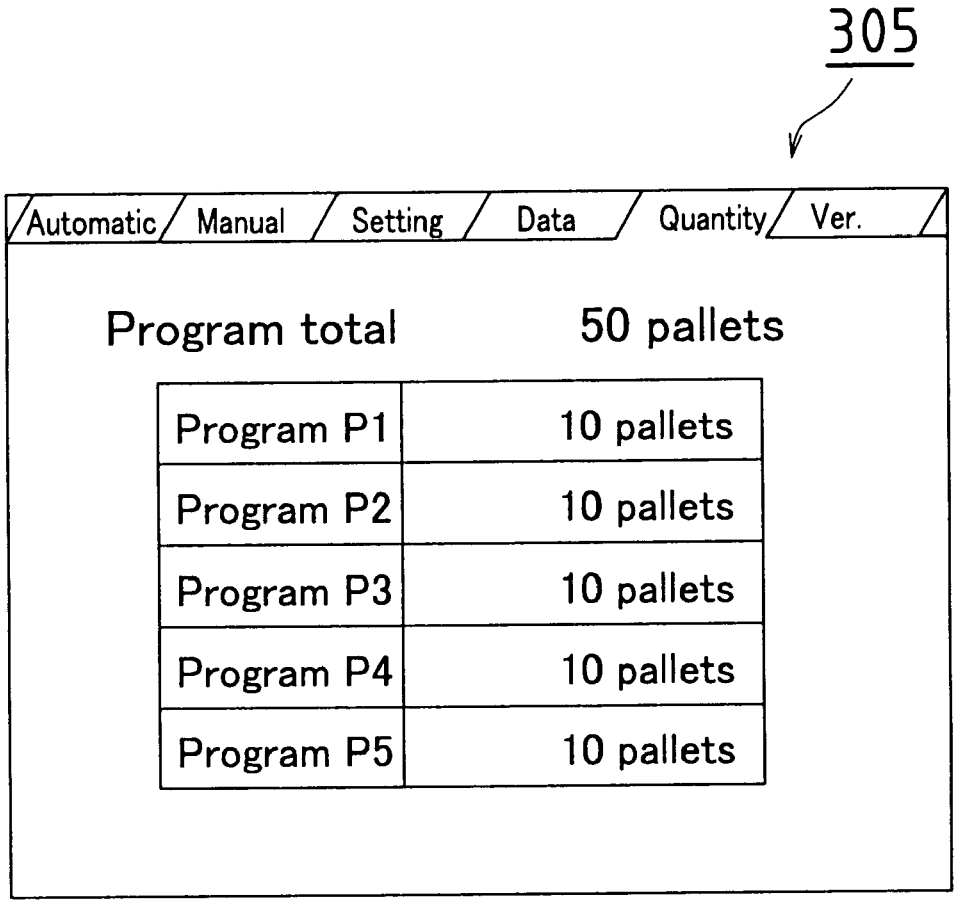

The data indication screen 304 shown in FIG. 9 displays data of operating state, current wrapping time, amount of film used, etc. The quantity indication screen 305 shown in FIG. 10 displays the number of pallets to be processed in accordance with programs P1 to P5.

The controller 11 is arranged to control the number of turntable rotations, the up-down speed of the carriage, the upper limit of the carriage position, the number of feed roller rotations (the film feed amount) and the stretch ratio, based on the values set by the touch panel input device 12 and the output signals from the photoelectric switch 21 and the load cell 64. The control process of each requirement is described in detail.

[Number of turntable rotations]

Based on the set value of the number of turntable rotations as set by the touch panel input device 12, the controller 11 supplies a control signal to the inverter 14 via the D/A converter 18 and controls the frequency of the electric power introduced to the turntable rotation motor 30, such that the number of rotations of the turntable rotation motor 30 matches the set value.

[Carriage up-down speed]

The controller 11 computes the carriage up-down speed relative to the number of rotations of the turntable 3, based on the values of the number of turntable rotations and the overlap amount as set by the touch panel input device 12. In order to match the up-down speed of the carriage 4 with the computed carriage up-down speed, the controller 11 supplies a control signal to the inverter 15 via the D/A converter 18 and controls the frequency of the electric power introduced to the carriage up-down motor 50.

[Upper limit of the carriage position]

Figure 11:
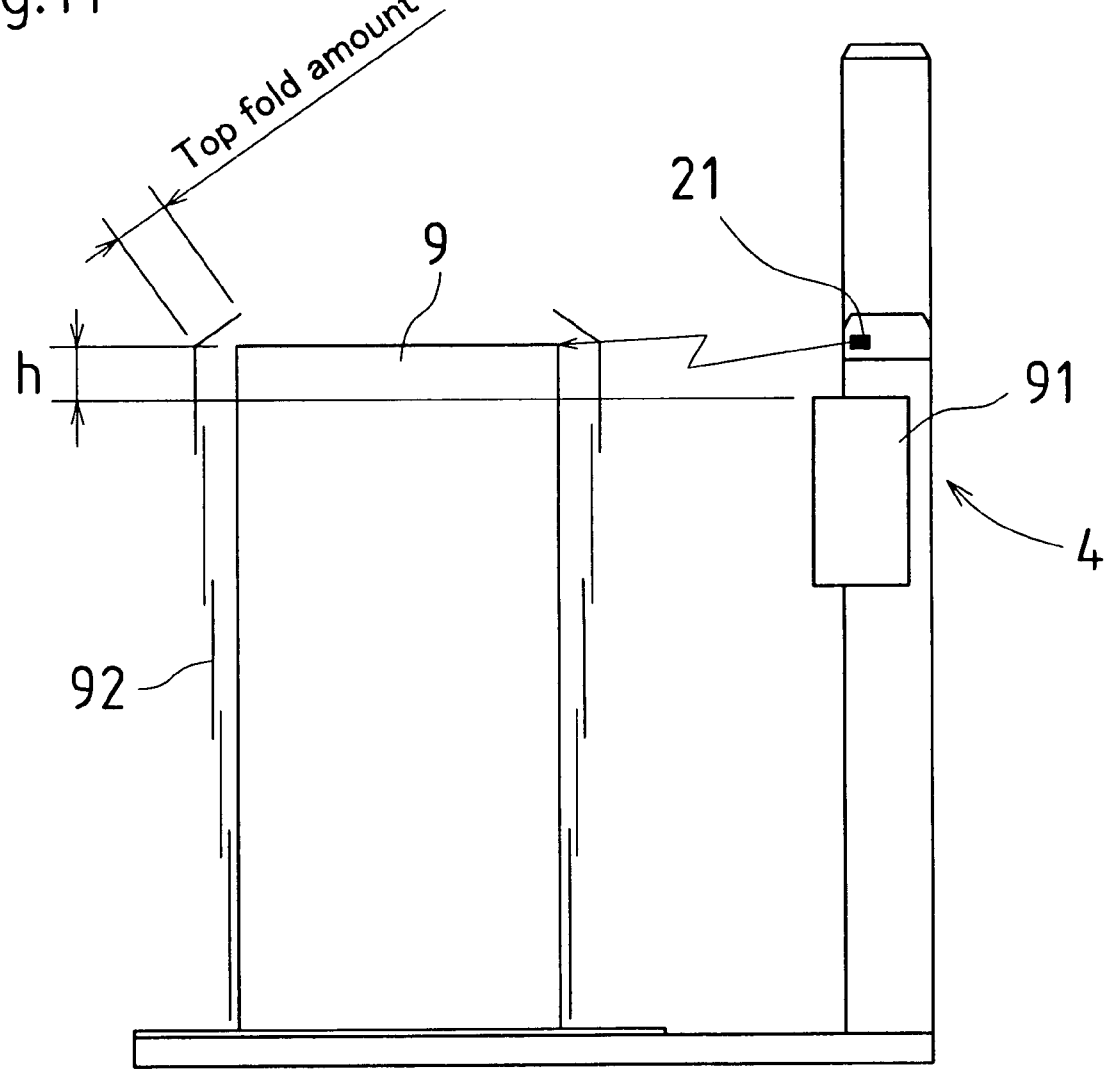
FIG. 11 is a view which explains a manner of controlling the upper limit of the carriage position.

The controller 11 computes the upper limit of the upward travel of the carriage 4, based on the value of the amount of top fold as set by the touch panel input device 12, the detection-OFF signal from the photoelectric switch 21 and the distance h between the photoelectric switch 21 and the upper end of the film roll 91 (see FIG. 11). The computed upper limit and the carriage up-down speed is used to obtain the time for the carriage 4 to reach the upper limit, according to which the upper limit of the carriage position is controlled.

[Number of feed roller rotations]

Based on the value of the wrapping tension as set by the touch panel input device 12, the controller 11 computes a difference between the set value of the wrapping tension and a measured value of the wrapping tension constantly obtained through the output signals of the load cell 64, i.e. detected values of the load (tension). In order to decrease the computed difference to zero, the controller 11 supplies a control signal to the inverter 16 via the D/A converter 18, and thereby feedback-controls the frequency of the electric power introduced to the film feed motor 71, namely, the number of rotations of the feed roller 61.

[Stretch ratio]

Based on the value of the stretch ratio as set by the touch panel input device 12 and the number of rotations of the feed roller 61 under feedback control, the controller 11 constantly computes the number of rotations of the stretch roller 62 as a target value. The controller 11 supplies a control signal to the inverter 17 via the D/A converter 18 so as to satisfy the target value, and thereby controls the frequency of the electric power introduced to the film stretch motor 72.

According to the embodiment shown in FIG. 1 to FIG. 11, it is possible to set and store film wrapping data for five types of pallet loads in various shapes, sizes, etc. When the load subjected to film wrapping is to be changed, the wrapping conditions can be automatically switched to the conditions for a new pallet load simply by selecting a program suitable for the new load on the automatic operation screen 301 of the touch panel input device 12. As a result, whenever the load subjected to film wrapping is changed, there is no longer any need for resetting the data such as number of turntable rotations, overlap amount, stretch ratio, wrapping tension, etc. Since the film wrapping operation can be quickly shifted from one type of load to another, this arrangement can enhance the operability of film wrapping.

When the film feed demand from the load 9 side varies, the number of rotations of the feed roller 61 is adjusted in real time in correspondence with the varied amount. Therefore, the film 92 can be wrapped around the load 9 at a certain constant tension to ensure good film wrapping. Further, because the number of rotations of the stretch roller 62 can follow the shift in the number of rotations of the feed roller 61, the pretension applied to the film 92 remains constant at any time.

Besides, since the film 92 is kept under a constant tension, the film 92 is thinly drawn by pretension at a high stretch ratio and still capable of being wrapped safely without being torn away. This is advantageous from an economic point of view. In the wrapping operation according to this embodiment, the thickness of the film 92 may be as thin as a half of the conventional film thickness (e.g. 16 $\mu$m) required for known prestretch wrapping machines. Thus, the amount (and the cost) of film 92 can be approximately halved with respect to the conventional technologies.

The following description relates to the operation processes taken when a failure occurs in the stretch wrapping machine.

When the emergency stop button 26 is pressed, the controller 11 transmits the information to the touch panel input device 12 so as to allow the display 13 to show the information.

On the other hand, the controller 11 successively monitors the operating state of the inverters 14, 15 connected to the turntable rotation motor 30 and the carriage up-down motor 50, and also successively monitors output signals from the limit switches 23, 24 for preventing the carriage 4 from travelling beyond the upper and lower limits and an output signal from the proximity sensor 25 located below the turntable 3. On detection of any failure, the information on the failure point and the failure details is transmitted to the touch panel input device 12 so as to allow the display 13 to show the information.

The failure screens for various occasions are described with reference to FIG. 12 to FIG. 16. In the present embodiment, the controller 11 also produces a buzzer sound to warn the device failure.

[Emergency stop screen]

A screen 401 is displayed when the emergency stop button 26 is pressed. As shown in FIG. 12, the screen of the display 13 shows operation buttons for stopping the buzzer sound and resetting the failure, together with messages "The emergency stop button on the panel is pressed." and "Release the lock by turning the button clockwise".

[Carriage descent failure screen]

A screen 402 indicates a mechanical failure which has occurred during the descent of the carriage 4. As shown in FIG. 13, the screen of the display 13 shows operation buttons for stopping the buzzer sound and resetting the failure, together with instructions "1) Check if the lower limit switch is activated. Remove an obstacle.", "2) Check if the carriage has reached the floor." and "3) Check if the wiring for the limit switch is disconnected."

The screen 402 of FIG. 13 also includes buttons for selecting "Drawing" or "Photograph". Where it is difficult to find the failure point only by means of the messages in letters, the button "Drawing" or "Photograph" is pressed to show the failure point in the form of a drawing or photograph on the screen of the display 13.

For an average operator, it is difficult to see whether the limit switch 24 below the carriage 4 is disconnected. Therefore, this embodiment further allows the screen of the display 13 to present a button for selecting a device monitor which is designed to show the state of the limit switch, etc. The operation of the limit switch 24 is tested by pressing a limit switch shown on the screen to check if the limit switch 24 is disconnected.

If the information on the carriage descent failure cannot be displayed on the single screen, a screen switch button "Further information" is arranged to appear on the screen of the display 13, as shown in FIG. 13, so as to guide an operator to additional operations or the like.

[Carriage upper/lower limit sensors failure screen]

A screen 403 indicates an operation failure of the two limit switches 23, 24 provided above and below the carriage 4. As shown in FIG. 14, the screen of the display 13 shows operation buttons for stopping the buzzer sound and resetting the failure, together with a failure message "The upper and lower limit switches are both ON at the same time." and instructions "1) Check if the lever touches anything. Make sure the lever is secured tightly.", "2) Check if the wiring of the sensors is disconnected."Similar to the above display example, this screen also includes the button for selecting the device monitor, so that the disconnection of the two limit switches 23, 24 is easily checked by pressing the limit switches shown on the screen.

As in the above display example, the screen 403 of FIG. 14 also includes buttons for selecting "Drawing" or "Photograph" which can help clearer understanding of the problem. Likewise, if the failure information on the carriage upper/lower limit sensors cannot be displayed on the single screen, a screen switch button "Further information" is arranged to appear on the screen of the display 13.

[Turntable sensor failure screen]

A screen 404 indicates a failure of the proximity sensor 25 disposed below the turntable 3. As shown in FIG. 15, the screen of the display 13 shows operation buttons for stopping the buzzer sound and resetting the failure, together with a failure message "The proximity sensor below the turntable is not working." and instructions "1) Check if the wiring of the sensor is disconnected." and "2) Check if the sensor is fixed at a proper position." As in the above display examples, the button for selecting the device monitor is presented, so that the disconnection of the proximity sensor 25 can be tested easily by operating the button.

Similar to the above display examples, the screen 404 of FIG. 15 includes buttons for selecting "Drawing" or "Photograph" which can help clearer understanding of the problem. Likewise, if the information on the turntable sensor failure cannot be displayed on the single screen, a screen switch button "Further information" is arranged to appear on the screen of the display 13.

[Carriage inverter failure screen]

Figure 16:
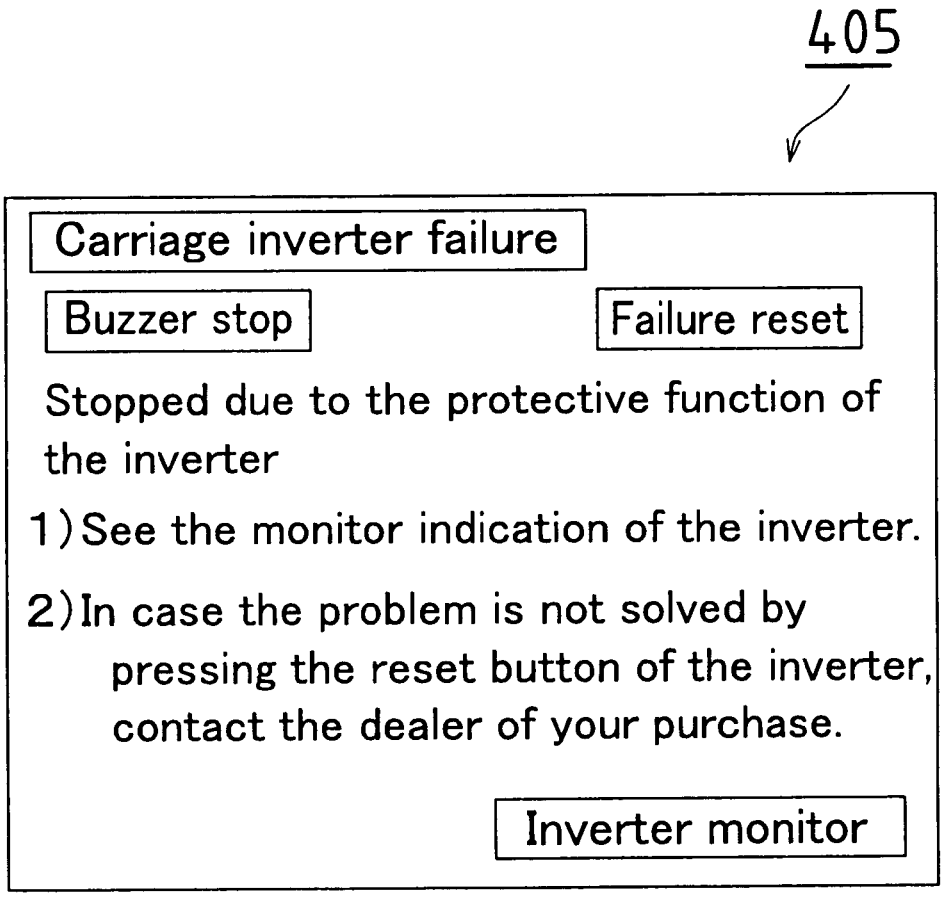

A screen 405 indicates a failure of the inverter 15 connected to the carriage up-down motor 50. As shown in FIG. 16, the screen of the display 13 shows operation buttons for stopping the buzzer sound and resetting the failure, together with a failure message "Stopped due to the protective function of the inverter." and instructions "1) See the monitor indication of the inverter." and "2) In case the problem is not solved by pressing the reset button of the inverter, contact the dealer of your purchase."

As for the monitor indication of the inverter, a monitor indication manual is incorporated in the inverter, so that a failure message is consulted by operating the button "Inverter monitor" on the screen 405.

[Turntable inverter failure screen]

This screen indicates a failure of the inverter 14 connected to the turntable rotation motor 30 and shows the same failure message and instructions as shown in FIG. 16. However, the heading of the screen should read "Turntable inverter failure" instead of "Carriage inverter failure".

Figure 17:
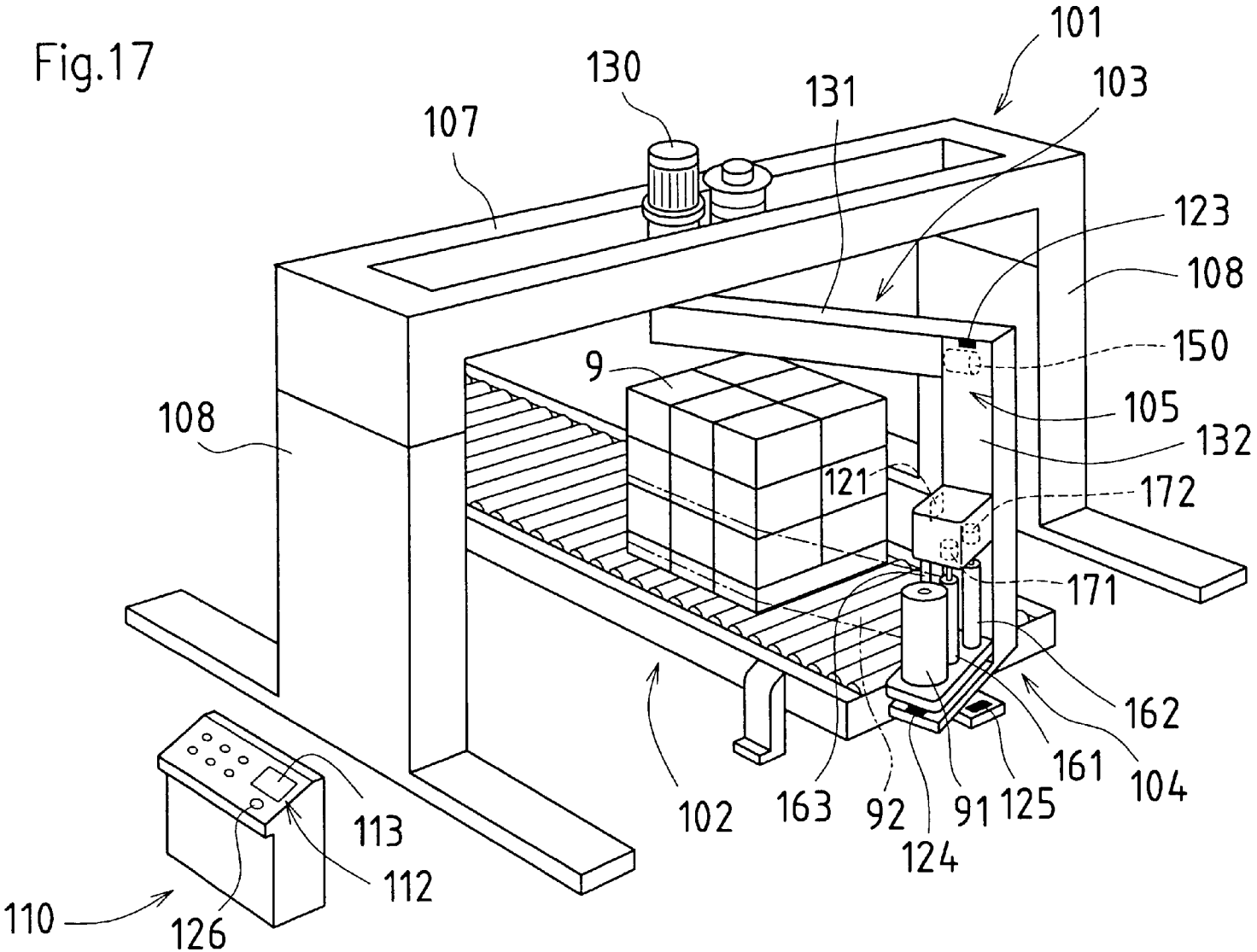
FIG. 17 is a perspective view schematically showing the overall structure of an embodiment of a rotary arm type stretch wrapping machine according to the present invention.

FIG. 17 illustrates an embodiment of a rotary arm type stretch wrapping machine according to the present invention.

The stretch wrapping machine of this embodiment principally comprises a gate-like frame 101 composed of a top beam 107 and base frames 108 supporting both ends thereof, a conveyor 102, an arm 103, a carriage 104, an elevator mechanism 105, a film feeder 106 and a control box 110. The panel of the control box 110 includes a touch panel input device 112 having a display 113.

The conveyor 102 serves to deliver and place the pallet load 9 at a position below the center of the top beam 107 of the frame 101.

The arm 103 is an inverted L-shaped member composed of a horizontal beam 131 and a vertical beam 132, with the horizontal beam 131 rotatably cantilevered at the center of the top beam 107 of the frame 101. The arm 103 is rotated by an arm revolution motor 130 disposed at the top center of the top beam 107 of the frame 101. With the rotation of the arm 103, the carriage 104 turns (revolves) around lateral surfaces of the load 9 which is placed in the center of the frame 101.

The carriage 104 is held by the vertical beam 132 of the arm 103 in a vertically movable manner, and displaced upwards and downwards by means of the elevator mechanism 105. The elevator mechanism 105 comprises a carriage up-down motor 150 and a belt (not shown) entrained around the rotation shaft of the motor 150 via a pulley or the like. The rotation of the carriage up-down motor 150 moves the belt up and down, thereby to raise and lower the carriage 104.

A photoelectric switch 121 is disposed at the top of the carriage 104 for detecting the load 9 placed in the center of the frame 101 (on the conveyor 102). While the carriage 104 rises from the lower limit (original position), the photoelectric switch 121 remains turned on as long as the detection light catches the load 9. When the detection light misses the load 9, i.e. when the photoelectric switch 121 locates above the top end of the load 9, the switch 121 is turned off.

The carriage 104 is mounted with the film feeder 106. The film feeder 106 is similar to the film feeder 6 shown in FIG. 2 and FIG. 3 above, and comprises a feed roller 161, a tension roller 162, a film feed motor 171 and a film stretch motor 172. With prestretching the film 92 which is unrolled from the film roll 91, the film feeder 106 allows the film 92 to pass along the feed roller 161 and the guide roller 163 and to be fed onto lateral surfaces of the load 9 on the conveyor 102.

Similar to the structure shown in FIG. 4, since the guide roller 163 is held by a load cell, the load cell can directly detect the force exerted on the guide roller 163, i.e. a load (tension) imposed on the film 92 fed onto the load 9 (article). The output from the load cell serves to provide numerical (digital) information of the tension imposed on the film 92.

In use of the stretch wrapping machine of this embodiment, the film roll 91 is mounted on the carriage 104, and the pallet load 9 is placed in the center of the frame 101. Under these conditions, the stretch wrapping machine feeds the film 92 from the film roll 91 onto the lateral surfaces of the load 9 by rotating the arm 103, and, at the same time, wraps the film 92 spirally around the load 9 by raising and lowering the carriage 104 along the vertical beam 132 of the arm 103.

Additionally, above and below the carriage 104, there are limit switches 123, 124 for preventing the carriage 104 from travelling beyond the upper limit and the lower limit. A proximity sensor 125 is provided below the carriage 104 in order to detect the original position of the carriage 104 with respect to the rotation direction.

Now, the structure of the control system of this embodiment is described with reference to the block diagram of FIG. 18 and FIG. 17 above.

The control system of this embodiment comprises a controller 111 and a touch panel input device 112 for setting the wrapping condition data in the controller 111.

The controller 111 supplies control signals via a D/A converter 118 to inverters 114, 115, 116, 117 connected to the arm revolution motor 130, the carriage up-down motor 150, the film feed motor 171 and the film stretch motor 172, respectively.

The controller 111 receives an output from the photoelectric switch 121 equipped on the carriage 104, and, via an A/D converter 119, an output from a load cell 164 disposed at the film feeder 106.

The inverters 114, 115 connected to the arm revolution motor 130 and the carriage up-down motor 150 have a protective function. When the protective function is activated, a failure signal is transmitted to an external device, and the failure details which triggered the protective function are displayed on an operation panel (on the inverter side). The failure signals from the inverters 114, 115 are supplied to the controller 111.

Similar to the examples shown in FIG. 6 to FIG. 10, the touch panel input device 112 allows the display 113 to selectively display any of the automatic operation screen 301, the manual operation screen 302, the setting screen 303, the data indication screen 304 and the quantity indication screen 305. The screen can be selected by touching, with a finger, any of the indexes marked "Automatic", "Manual", "Setting", "Data" and "Quantity" at the top of the screens 301, 302, 303, 304, 305. In this embodiment, however, the number of turntable rotations (rpm) shown on the setting screen 303 of FIG. 8 should be replaced with the number of arm revolutions (rpm), and the term "Turntable" on the automatic operation screen 302 of FIG. 7 should read "Arm", instead. In addition, the panel of the touch panel input device 112 (the control box 110) includes an emergency stop button 126 (FIG. 17).

The controller 111 is arranged to control the number of arm revolutions, the up-down speed of the carriage, the upper limit of the carriage position, the number of feed roller rotations (the film feed amount) and the stretch ratio, based on the values set by the touch panel input device 112 and the output signals from the photoelectric switch 121 and the load cell 164. The control process of each requirement is carried out as explained in the above embodiment, except that the number of turntable rotations is replaced with the number of arm revolutions. Therefore, no further description is necessary.

Figure 18:
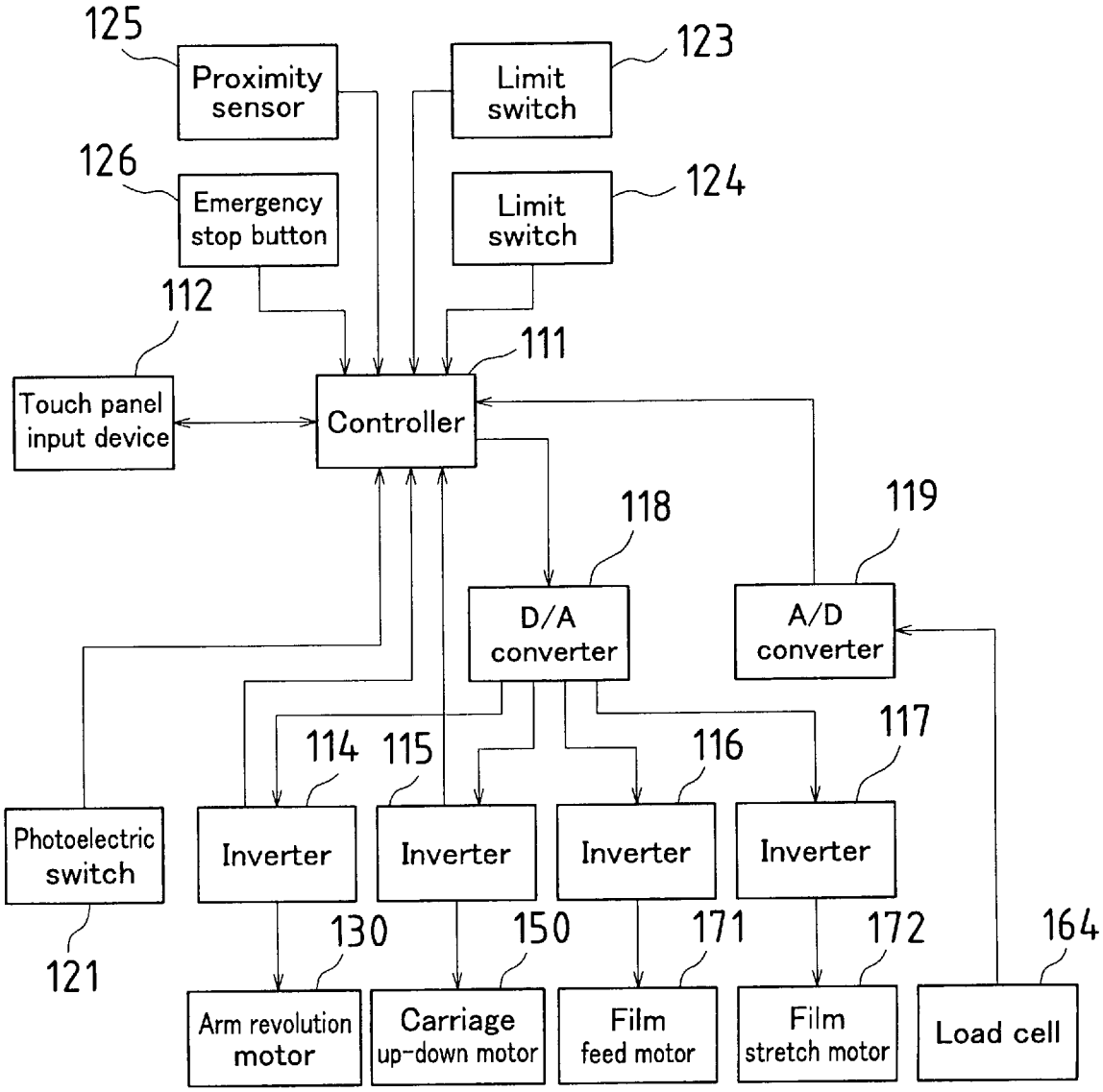
FIG. 18 is a block diagram showing the structure of a control system in the stretch wrapping machine of FIG. 17.

According to the embodiment shown in FIG. 17 and FIG. 18, it is likewise possible to set and store film wrapping data for five types of pallet loads in various shapes, sizes, etc. When the load subjected to film wrapping is to be changed, the wrapping conditions can be automatically switched to the conditions for a new pallet load simply by selecting a program suitable for the new load on the automatic operation screen of the touch panel input device 112. As a result, whenever the load subjected to film wrapping is changed, there is no longer any need for resetting the data such as number of arm revolutions, overlap amount, stretch ratio, wrapping tension, etc. Since the film wrapping operation can be quickly shifted from one type of load to another, this arrangement can enhance the operability of film wrapping.

Also in this embodiment, when the emergency stop button 126 is pressed at the time of failure, the controller 111 transmits the information to the touch panel input device 112 so as to allow the display 113 to show the information.

On the other hand, the controller 111 successively monitors the operating state of the inverters 114, 115 connected to the arm revolution motor 130 and the carriage up-down motor 150, and also successively monitors output signals from the limit switches 123, 124 for preventing the carriage 104 from travelling beyond the upper and lower limits and an output signal from the proximity sensor 125 for detecting the original position of the carriage 104. On detection of any failure, the information on the failure point and the failure details is transmitted to the touch panel input device 112 so as to allow the display 113 to show the information.

It should be understood that the indications on the screens are similar to those mentioned in the above embodiment, except that the term "Turntable" should read "Arm" instead. Therefore, no further explanation is necessary.

Figure 19:
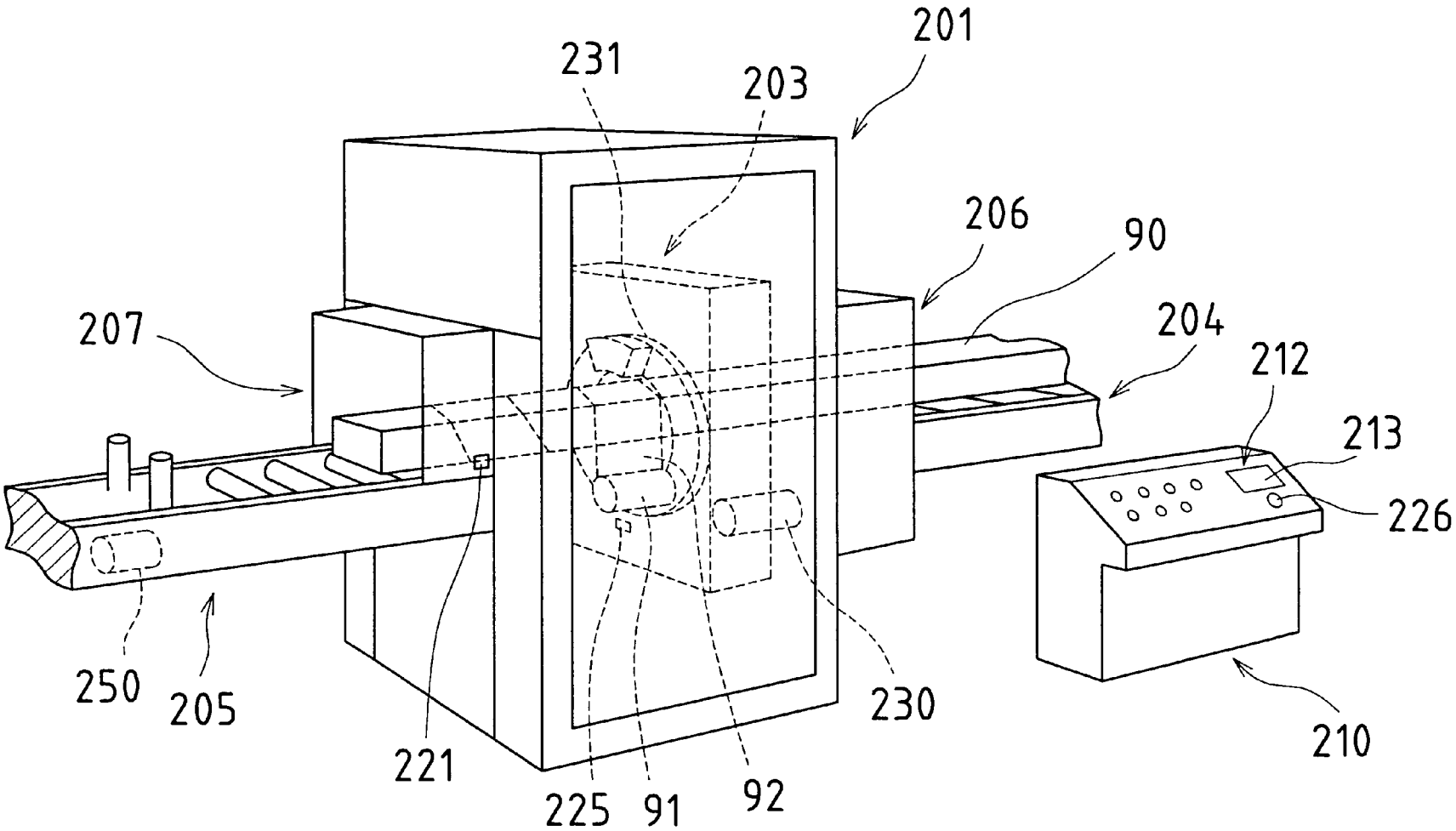
FIG. 19 is a perspective view schematically showing the overall structure of an embodiment of a rotary drum type stretch wrapping machine according to the present invention.

FIG. 19 illustrates an embodiment of a rotary drum type stretch wrapping machine according to the present invention.

The stretch wrapping machine of this embodiment principally comprises a casing 201 of rectangular box shape which has an entrance 206 and an exit 207 for passing a long load 90, a film wrapper 203 installed inside the casing 201, conveyors 204, 205 each located at the upstream side and downstream side of the casing 201 and a control box 210. The panel of the control box 210 includes a touch panel input device 212 having a display 213.

Photoelectric switches 221 are disposed at the sides of the entrance 206 and the exit 207 of the casing 201. While the load 90 is passing through the film wrapper 203, each photoelectric switch 221 remains turned on as far as the detection light catches the load 90. When the detection light misses the load 90, the switch 221 is turned off.

Figure 20:
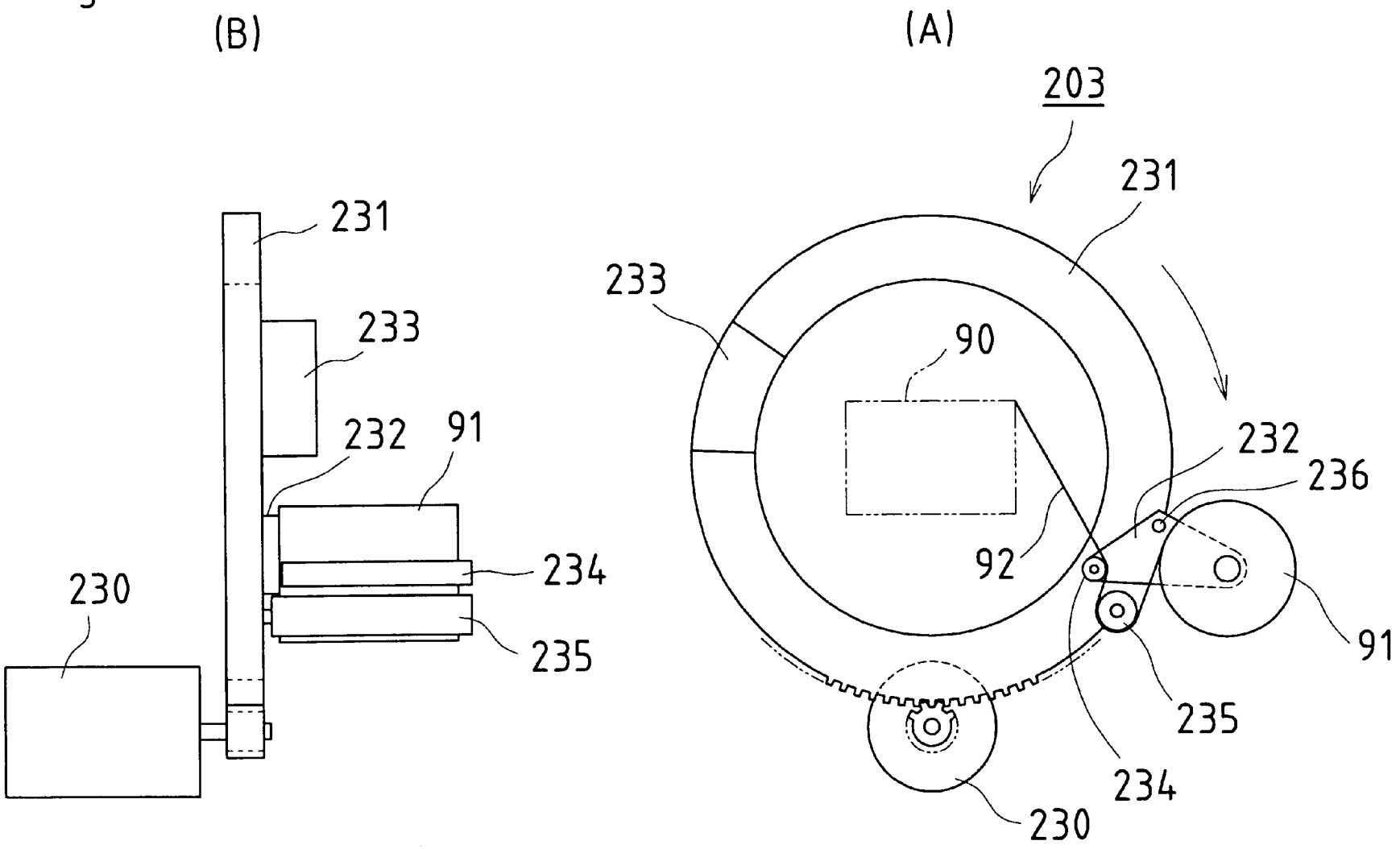
FIG. 20(A) is a front view schematically showing the essential part of a film wrapper used in the stretch wrapping machine of FIG. 19.
FIG. 20(B) is a side view thereof.

As shown in FIGS. 20(A), (B), the film wrapper 203 includes a ring-shaped drum 231 which is capable of turning (rotating) around an axis which extends straight along the carrying direction of the conveyors 204, 205, and a drum rotation motor 230 for rotating the drum 231 along the external periphery of the load 90. The drum 231 is equipped with a carriage 232 for holding a film roll 91 and a balancer 233 for stabilizing the rotation.

The carriage 232 is swingably held on the drum 231 via a pin 236. The carriage 232 has a free roller 234 disposed opposite to the film roll 91. In addition, a stretch roller 235 (rubber roller) is located near the carriage 232.

Referring to FIG. 20(A), in the film wrapper 203 of the above structure, a film 92 is rolled out from the film roll 91, entrained around the stretch roller 235, then led via the free roller 234, and finally fed onto lateral surfaces of the load 90. The stretch roller 235 includes an adjustment mechanism for controlling spool movement by an elastic force of a spring or the like. Hence, this adjustment mechanism allows an operator to manually adjust the tension of the film 92 to be wrapped around the load 90.

The conveyors 204, 205 allow the long load 90 to pass through the film wrapper 203 at a constant feed. The feed rate is adjusted by controlling the frequency of the electric power supplied to conveyor motors 250 (not shown on the upstream side).

In the stretch wrapping machine of this embodiment, the long load 90 is placed on the conveyor 204, with its leading end located inside the drum 231 of the film wrapper 203. Then, with the conveyors 204, 205 being driven to give a constant feed to the load 90 and the drum 231 being rotated, the film 92 is rolled out from the film roll 91 and fed onto the lateral surfaces of the load 90. Thus, the film 92 can be spirally wrapped around the long load 90. Alternatively, it is possible to wrap (bundle) only both ends of the long load 90, by locating the leading end or trailing end of the long load 90 inside the drum 231 and rotating the drum 231 without providing a feed from the conveyor 204.

In addition, a proximity sensor 225 is disposed below the drum 231 in order to detect the original position (rotation direction) of the drum 231 (FIG. 19).

Figure 21:
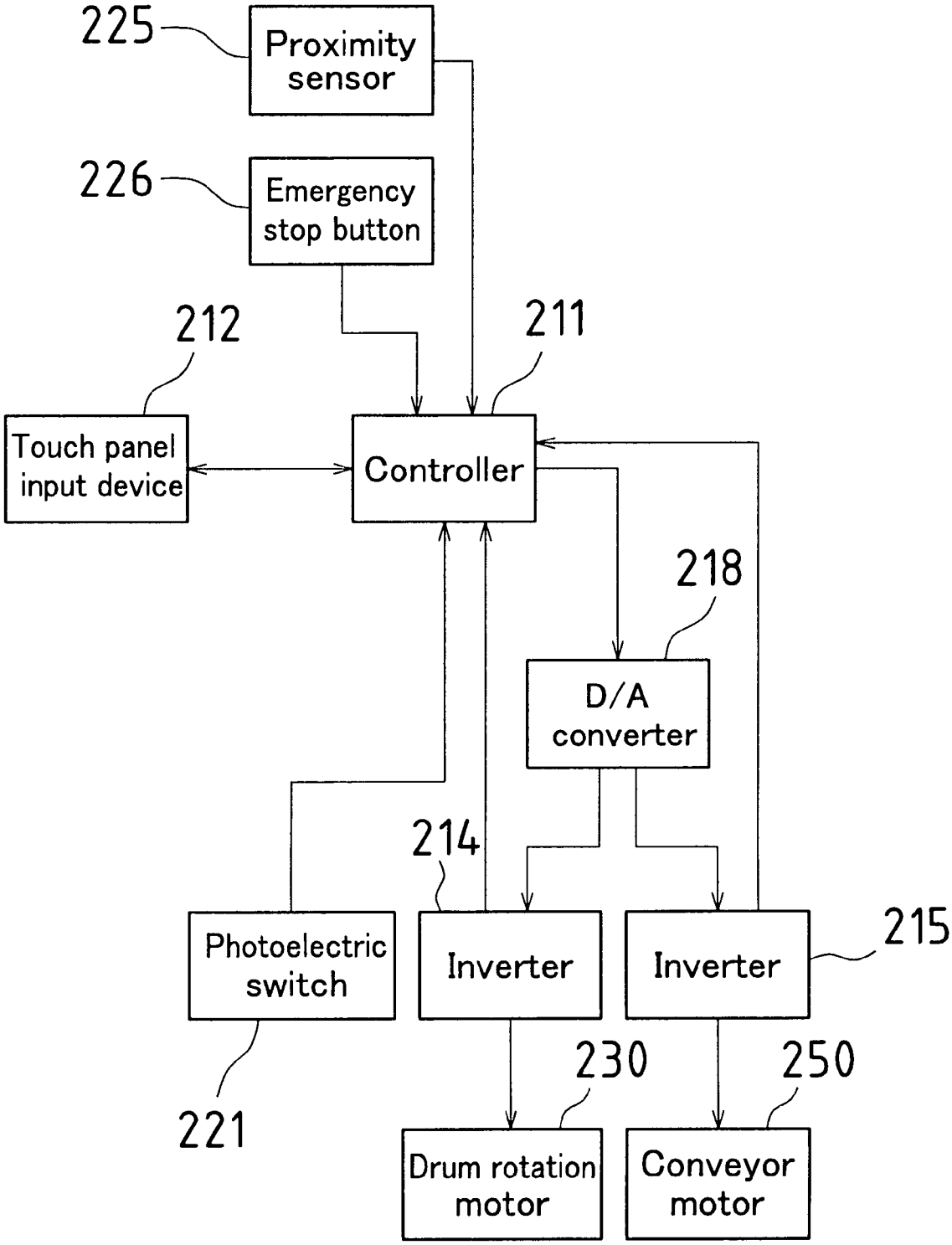
FIG. 21 is a block diagram showing the structure of a control system in the stretch wrapping machine of FIG. 19.

Now, the structure of the control system of this embodiment is described with reference to the block diagram of FIG. 21 and FIG. 19 above.

The control system of this embodiment comprises a controller 211 and a touch panel input device 212 for setting the wrapping condition data in the controller 211.

The controller 211 supplies control signals via a D/A converter 218 to inverters 214, 215 connected to the drum rotation motor 230 and the conveyor motors 250, respectively. The controller 211 is supplied with an output from the electromagnetic switch 221.

The inverters 214, 215 connected to the drum rotation motor 230 and the conveyor motors 250 have a protective function. When the protective function is activated, a failure signal is transmitted to an external device, and the failure details which triggered the protective function are displayed on an operation panel (on the inverter side). The failure signals from the inverters 214, 215 are supplied to the controller 211.

As shown in FIG. 22 to FIG. 26, the touch panel input device 212 allows the display 213 to selectively display any of an automatic operation screen 321, a manual operation screen 322, a setting screen 323, a data indication screen 324 and a quantity indication screen 325. The screen can be selected by touching, with a finger, any of the indexes marked "Automatic", "Manual", "Setting", "Data" and "Quantity" at the top of the screens 321, 322, 323, 324, 325. The panel of the touch panel input device 212 (the control box 210) also includes an emergency stop button 226 (FIG. 19).

Figure 22:
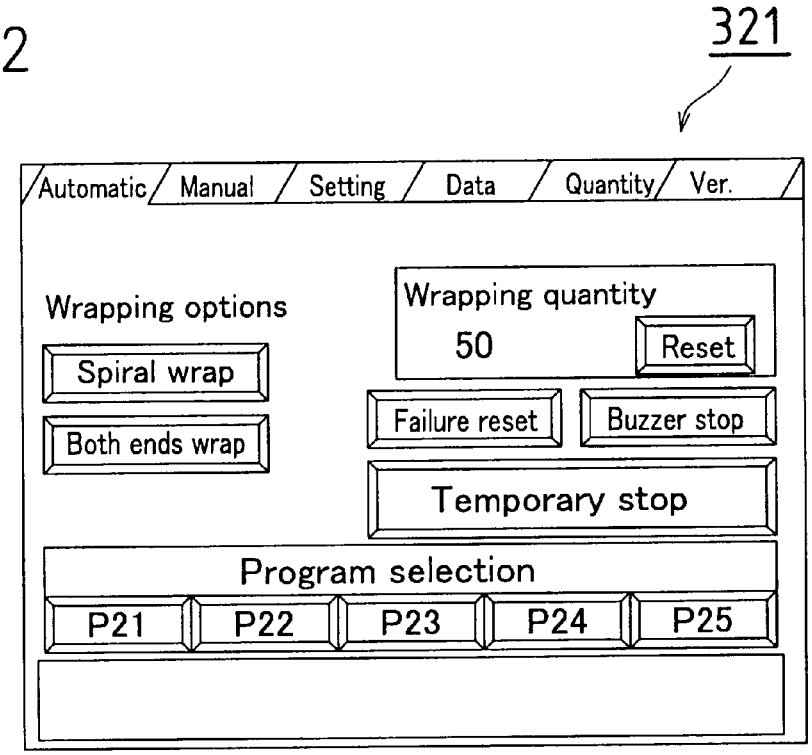

As shown in FIG. 22, the automatic operation screen 321 displays input keys for wrapping options (overall spiral wrap/both ends wrap) and wrapping quantity, as well as program selection keys for selecting any of programs P21 to P25 to be mentioned below.

Figure 23:
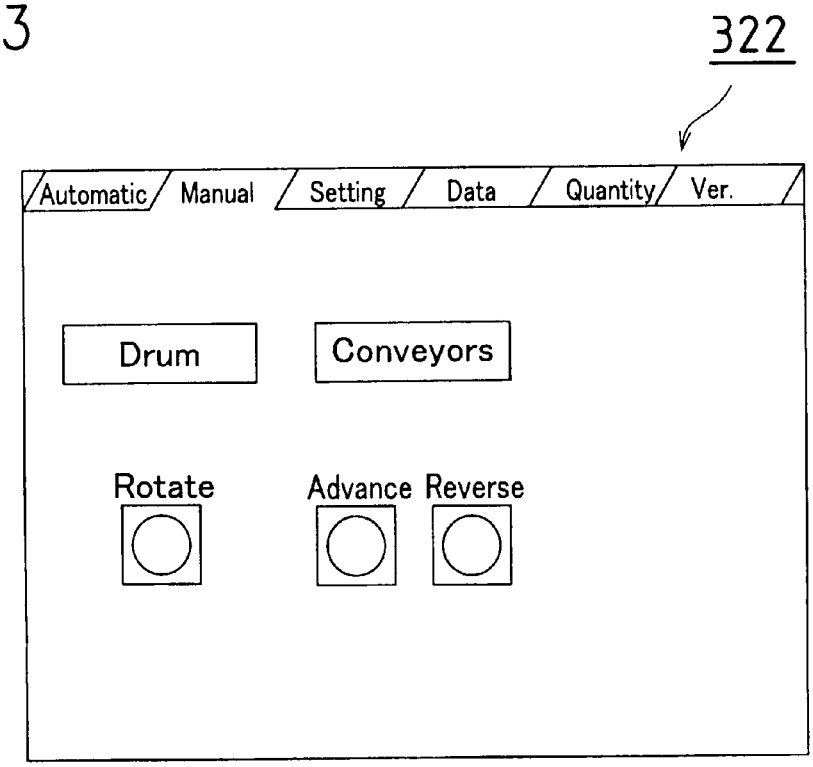

As shown in FIG. 23, the manual operation screen 322 displays a manual operation button for rotating the drum 231 and manual operation buttons for advancing and reversing the conveyors 204, 205.

Figure 24:
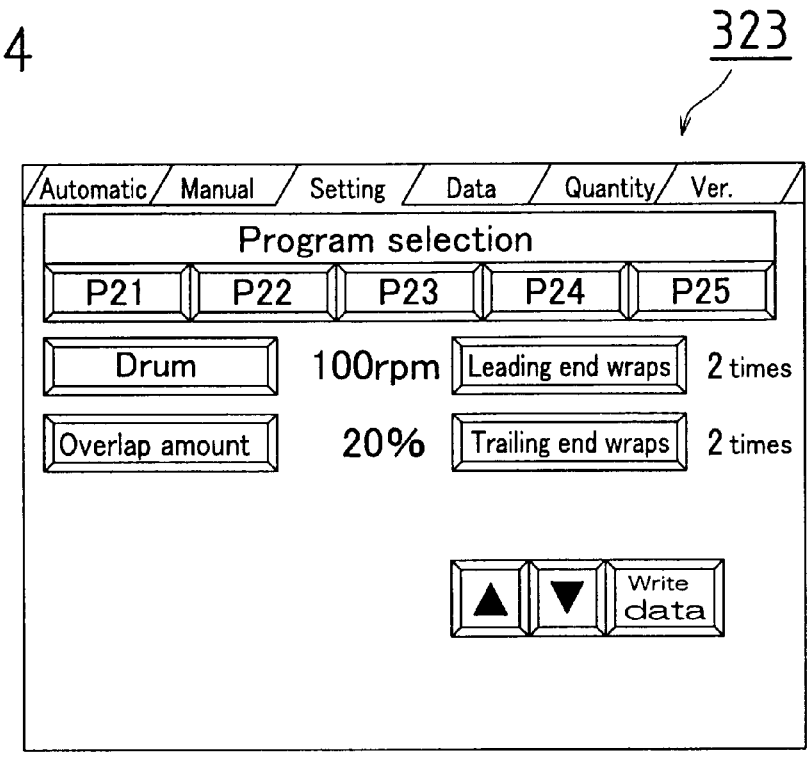

As shown in FIG. 24, the setting screen 323 displays item designation keys for designating an item to be set (e.g. number of drum rotations, overlap amount), UP/DOWN keys for the input of numerical values for each item to be set, and program selection keys for selecting any of programs P21 to P25. This setting screen 323 provides digital (numerical) presentation of the set value of each item, and allows each value to be entered by the operation of the UP/DOWN keys. After the values of all items are entered, the set data can be stored by pressing a "Write data" key, followed by one of the program selection keys. Up to five types of set data can be stored in this manner.

Figure 25:
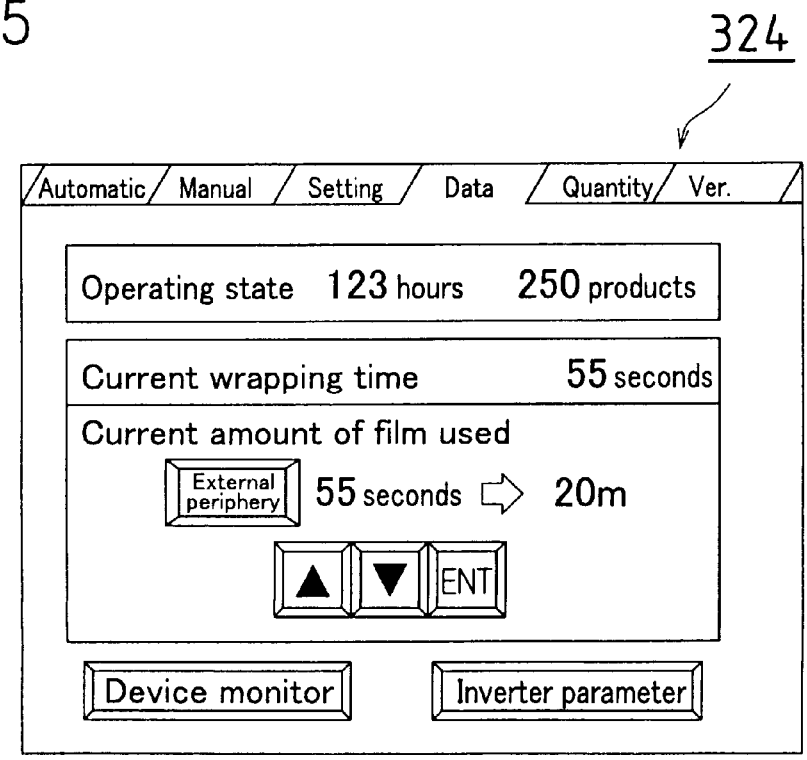

The data indication screen 324 shown in FIG. 25 displays data of operating state, current wrapping time, amount of film used, etc. The quantity indication screen 325 shown in FIG. 26 displays the number of products to be processed in accordance with programs P21 to P25.

The controller 211 controls the number of drum rotations and the conveyor speed, based on the values set by the touch panel input device 212. The control process of each requirement is described in detail.

[Number of drum rotations]

Based on the set value of the number of drum rotations as set by the touch panel input device 212, the controller 211 supplies a control signal to the inverter 214 via the D/A converter 218 and controls the frequency of the electric power introduced to the drum rotation motor 230, such that the number of rotations of the drum rotation motor 230 matches the set value. On receiving an OFF signal from the photoelectric switch 221 (which indicates the completion of wrapping), the controller 211 stops the drum rotation motor 230.

[Conveyor speed]

The controller 211 computes the conveyor speed relative to the number of rotations of the drum 231, based on the values of the number of drum rotations and the overlap amount as set by the touch panel input device 212. In order to match the speed of the conveyor 205 with the computed conveyor speed, the controller 211 supplies a control signal to the inverter 215 via the D/A converter 218, and controls the frequency of the electric power introduced to the conveyor motors 250.

According to the embodiment shown in FIG. 19 to FIG. 26, it is possible to set and store film wrapping data of five types of palletized long loads in various shapes, sizes, etc. When the load subjected to film wrapping is to be changed, the wrapping conditions can be automatically switched to the conditions for a new load simply by selecting a program suitable for the new load on the automatic operation screen 321 of the touch panel input device 212. As a result, whenever the load subjected to film wrapping is changed, there is no longer any need for resetting the data such as number of drum rotations, overlap amount, etc. Since the film wrapping operation can be quickly shifted from one type of load to another, this arrangement can enhance the operability of film wrapping.

The following description relates to the operation processes taken when a failure occurs in this embodiment.

When the emergency stop button 226 is pressed, the controller 211 transmits the information to the touch panel input device 212 so as to allow the display 213 to show the information.

On the other hand, the controller 211 successively monitors the operating state of the inverters 214, 215 connected to the drum rotation motor 230 and the conveyor motors 250, and also successively monitors an output signal from the proximity sensor 225 for detecting the original position of the drum 231. On detection of any failure, the information on the failure point and the failure details is transmitted to the touch panel input device 212 so as to allow the display 213 to show the information.

The failure screens for various occasions are described below with reference to FIG. 27 to FIG. 29. In the present embodiment, the controller 211 also produces a buzzer sound to warn the device failure.

[Emergency stop screen]

A screen 421 is displayed when the emergency stop button 226 is pressed. As shown in FIG. 27, the screen of the display 213 shows operation buttons for stopping the buzzer sound and resetting the failure, together with messages "The emergency stop button on the panel is pressed." and "Release the lock by turning the button clockwise".

[Drum sensor failure screen]

A screen 422 indicates a failure of the proximity sensor 225 disposed below the drum 231. As shown in FIG. 28, the screen of the display 213 shows operation buttons for stopping the buzzer sound and resetting the failure, together with a failure message "The proximity sensor below the drum is not working." and instructions "1) Check if the wiring of the sensor is disconnected." and "2) Check if the sensor is fixed at a proper position."Similar to the above embodiments, this display example also presents the button for selecting the device monitor, so that the disconnection of the proximity sensor 225 can be tested easily by operating the button.

Likewise, as mentioned in the display examples of the above embodiments, the screen 422 of FIG. 28 includes buttons for selecting "Drawing" or "Photograph" which can help clearer understanding of the problem. Further, if the failure information on the drum sensor cannot be displayed on the single screen, a screen switch button "Further information" is arranged to appear on the screen of the display 213.

[Drum inverter failure screen]

A screen 423 indicates a failure of the inverter 214 connected to the drum rotation motor 230. As shown in FIG. 29, the screen of the display 213 shows operation buttons for stopping the buzzer sound and resetting the failure, together with a failure message "Stopped due to the protective function of the inverter." and instructions "1) See the monitor indication of the inverter." and "2) In case the problem is not solved by pressing the reset button of the inverter, contact the dealer of your purchase."

As for the monitor indication of the inverter, a monitor indication manual is incorporated in the inverter, so that a failure message is consulted by operating the button "Inverter monitor" on the screen 423.

[Conveyor inverter failure screen]

This screen indicates a failure of the inverter 215 connected to the conveyor motors 250 and shows the same failure message and instructions as shown in FIG. 29. However, the heading of the screen should read "Conveyor inverter failure" instead of "Drum inverter failure".

As described above, the above embodiments intend to facilitate recovery operations to solve a machine failure, by indicating the information on the failure point and failure details on the display of the touch panel input device. Alternatively, the failure information may be sent directly to a person in charge of maintenance on the manufacturer side, so that the manufacturer can understand the state of failure and arrange or instruct recovery operations.

Figure 30:
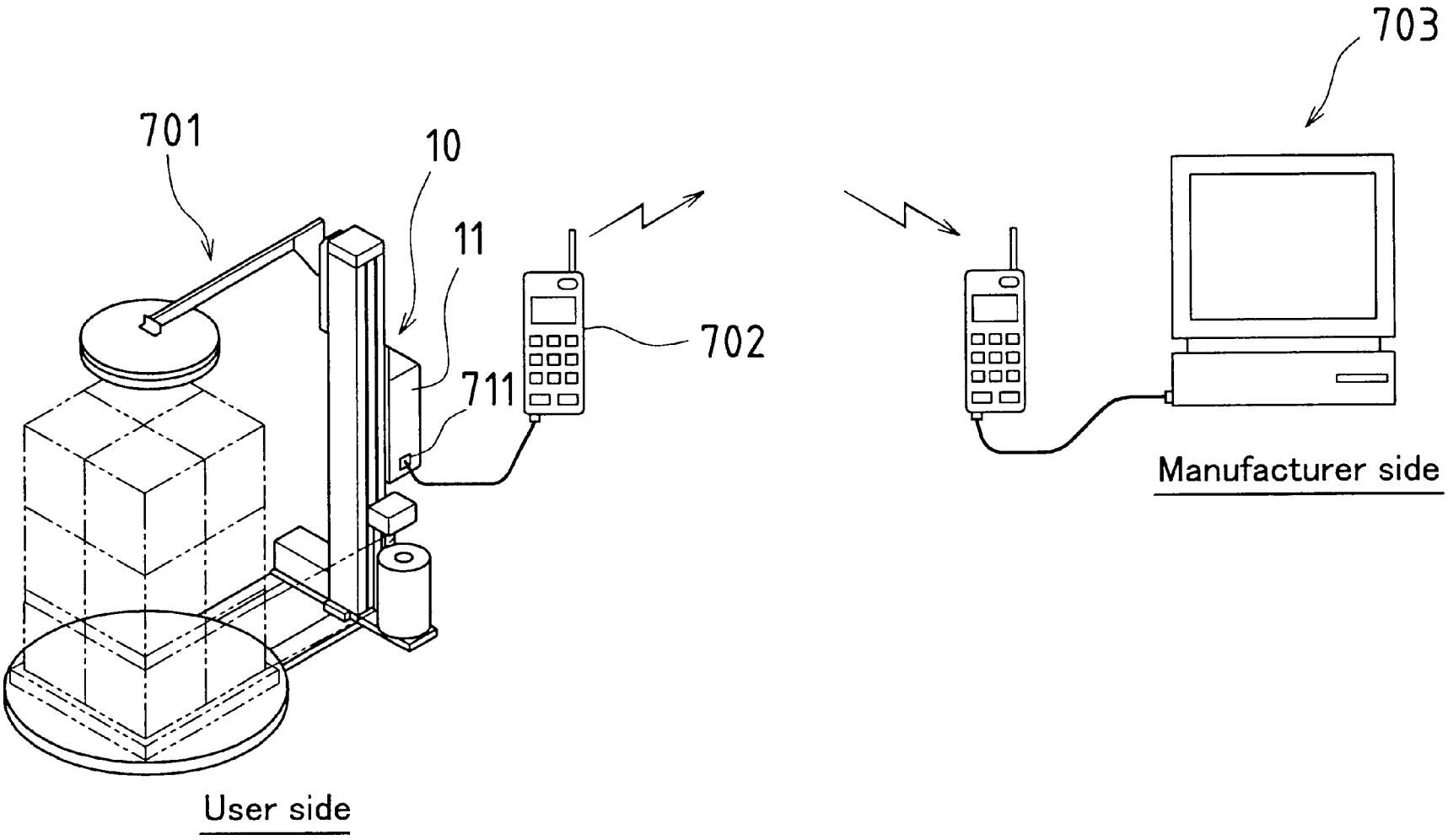
FIG. 30 is a schematic view showing a modified embodiment of the stretch wrapping machine of FIG. 1.
Figure 31:
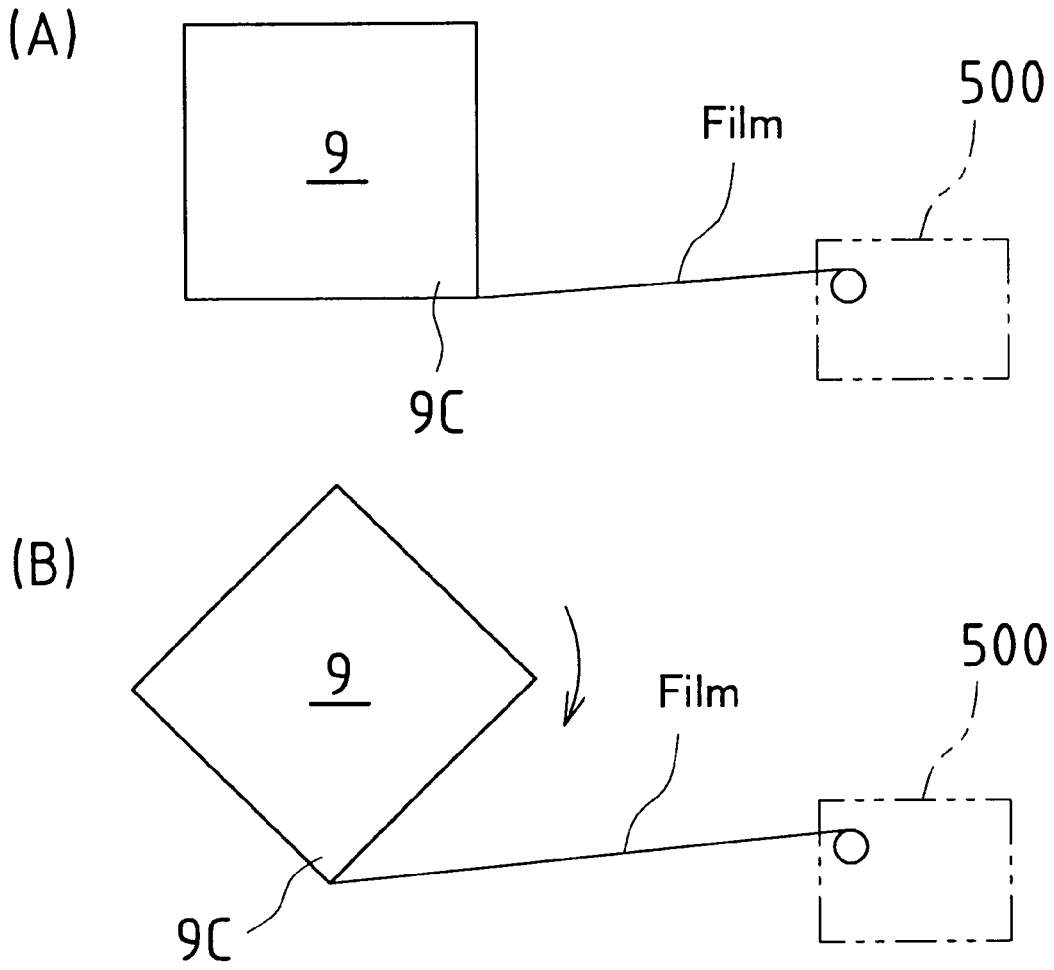
FIGS. 31(A) and (B) are views illustrating the variation of the film feed demand.

For example, referring to a stretch wrapping machine 701 shown in FIG. 30, the controller 11 is arranged to supply the failure information to an output terminal 711 provided at the control box 10. In the case of a failure, a mobile telephone 702 is connected to the output terminal 711 so as to send the failure information to manufacturer's personal computer 703 via a telecommunication system.

As another process, the output terminal 711 of the control box 10 may be linked with a personal computer, so that the failure information is sent from user's personal computer to manufacturer's personal computer via a communication network (e.g. Internet).

Owing to such system, the failure information can be directly sent to the manufacturer side, instead of being reported by an operator. Therefore, even if an operator is not familiar with the structure and operation of every part of the stretch wrapping machine, the manufacturer can understand the exact state of the failure. Consequently, the recovery operation can be completed in a short time.

Moreover, such system allows the manufacturer to determine whether the machine failure can be handled by the operator, before the manufacturer arranges a recovery operation. Thus, the manufacturer can avoid unnecessary dispatch of its maintenance person.

For example, a user often calls for a maintenance person for simple troubles which an operator can solve easily, such as when a memory back-up battery in the controller is used up or when a switch required for an operation is not turned on. However, a maintenance person will no longer be bothered by such a vain visit.

Incidentally, the above embodiments employ a load cell as the load detection means for detecting the load (tension) imposed on a film fed out onto a load (article). However, the load detection means should not be limited to the load cell, and other commonly known load censors can be utilized for the same purpose.

Besides, in the above embodiments, the load cell is disposed only on the upper end of the guide roller. For more accurate feedback control, load cells may be arranged to hold both the upper and lower ends of the guide roller.

Further, in lieu of the load cell, the film feeder may be equipped with rotation number detection means for detecting the number of rotations of the feed roller (e.g. rotary encoder). In this case, the detected value of the number of rotations is utilized to control the drive for the feed roller.

The above embodiments are designed to provide digital presentation of numeric values of the film wrapping data on the display of the touch panel input device. In addition, the present invention may be modified to provide digital presentation of film wrapping data in the form of graph, figure, etc.

The input means employed in the stretch wrapping machine of the present invention should not be limited to the above-mentioned touch panel input device, and can be selected from a variety of commonly known input devices.

What is claimed is:

1. A stretch wrapping machine comprising a carriage for mounting a film roll, a rotation mechanism for producing relative rotation between the carriage and an article to be wrapped, a feed mechanism for displacing the carriage relative to the article, and a controller for controlling a drive for each of the rotation mechanism and the feed mechanism, and arranged to feed a film to the article by providing relative rotation between the film roll-mounted carriage and the article and to wrap the film around the article by displacing the carriage relative to the article, wherein the stretch wrapping machine is equipped with a touch panel input device for setting film wrapping data into the controller and providing digital presentation of the set data and wherein the data set by the touch panel input device relate to the number of rotations of the rotation mechanism, any one of a film overlap amount and a feed rate of the feed mechanism, and a film wrapping tension.

2. A stretch wrapping machine according to claim 1, wherein the touch panel input device has a function of displaying a screen for selecting any one of a plurality of programs which are set and stored in advance.

3. A stretch wrapping machine according to claim 1, wherein the controller is arranged to monitor an occurrence of a machine failure, and, in the case of a failure, to indicate a failure point and failure details on a display of the touch panel input device.

4. A stretch wrapping machine according to claim 1, wherein the controller is arranged to monitor an occurrence of a machine failure, and, in the case of a failure, to supply information on a failure point and failure details to an output unit, so that the failure information can be sent from the output unit to a person in charge of maintenance via a communication network.

5. A stretch wrapping machine comprising a carriage for mounting a film roll, a rotation mechanism for producing relative rotation between the carriage and an article to be wrapped, a feed mechanism for displacing the carriage relative to the article, and a controller for controlling a drive for each of the rotation mechanism and the feed mechanism, and arranged to feed a film to the article by providing relative rotation between the film roll-mounted carriage and the article and to wrap the film around the article by displacing the carriage relative to the article, wherein the stretch wrapping machine is equipped with a touch panel input device for setting film wrapping data into the controller and providing digital presentation of the set data, and wherein the touch panel input device has a function of selectively displaying any one of a plurality of screens in response to a touch input, the screens including a setting screen for setting data on the number of rotations of the rotation mechanism, any one of a film overlap amount and a feed rate of the feed mechanism, and a film wrapping tension, an automatic operation screen for indicating a condition of an automatic operation and a manual operation screen for conducting a manual operation.

6. A stretch wrapping machine comprising a carriage mounted with a feed roller for feeding a film from a film roll, a rotation mechanism for providing relative rotation between the carriage and an article to be wrapped, a feed mechanism for displacing the carriage relative to the article, and a controller for controlling a drive for each of the rotation mechanism, the feed roller and the feed mechanism, and arranged to feed a film to the article by providing relative rotation between the film roll-mounted carriage and the article and to wrap the film around the article by displacing the carriage relative to the article, wherein the stretch wrapping machine is equipped with an input unit for setting film wrapping data into the controller, and wherein the controller is arranged to compute a feed rate of the feed mechanism by using a set value of the number of rotations of the rotation mechanism and a set value of the film overlap amount as set by the input unit, and to control a drive for the feed mechanism based on the computed feed rate.

7. A stretch wrapping machine comprising a carriage mounted with a feed roller for feeding a film from a film roll, a rotation mechanism for providing relative rotation between the carriage and an article to be wrapped, a feed mechanism for displacing the carriage relative to the article, and a controller for controlling a drive for each of the rotation mechanism, the feed roller and the feed mechanism, and arranged to feed a film to the article by providing relative rotation between the film roll-mounted carriage and the article and to wrap the film around the article by displacing the carriage relative to the article, wherein the stretch wrapping machine is equipped with an input unit for setting film wrapping data into the controller, and any one of a tension detection unit for detecting a film wrapping tension and a rotation number detection unit for detecting the number of rotations of the feed roller, and wherein the controller is arranged to compute a control amount of the feed roller by using any one of a value detected by the tension detection unit and a value detected by the rotation number detection unit and also using a set value of the wrapping tension as set by the input unit, and to control a drive for the feed roller based on the computed control amount.

8. A stretch wrapping machine according to claim 7, wherein the controller is arranged to compute a feed rate of the feed mechanism by using a set value of the number of rotations of the rotation mechanism and a set value of a film overlap amount as set by the input unit, and to control a drive for the feed mechanism based on the computed feed rate.

9. A stretch wrapping machine according to claim 7 or 8, wherein the tension detection unit is a load detection unit for detecting a load which is imposed on the film fed from the feed roller to the article, and wherein the controller is arranged to constantly compute a difference between a measured value of the wrapping tension obtained through an output signal of the load detection unit and a set value of the wrapping tension as set by the input unit, and to feedback-control the number of rotations of the feed roller in such a manner as to decrease the computed difference to zero.

10. A stretch wrapping machine according to claim 9, wherein the load detection unit is a load cell.

11. A stretch wrapping machine according to claim 6, 7 or 8, which further comprises a stretch roller disposed opposite to the feed roller, wherein the controller is arranged to compute a rotation ratio of the feed roller to the stretch roller by using a set value of a stretch ratio as set by the input unit, and to control the number of rotations of the stretch roller based on the computed rotation ratio.

12. A stretch wrapping machine according to claim 6, 7 or 8, wherein the feed mechanism is an elevator mechanism which displaces the carriage in upward and downward directions.

13. A stretch wrapping machine according to claim 12, which further comprises a top end detection unit for detecting a top end of the article, wherein the controller is arranged to compute an upper limit of an upward travel of the carriage by using a set value of an amount of top fold as set by the input unit and an output of the top end detection unit, then to obtain a time for the carriage to reach the upper limit by using the computed upper limit and a computed value of an up-down speed of the carriage, and thereby to control the upper limit of the upward travel of the carriage.

14. A stretch wrapping machine according to claim 6, 7 or 8, wherein the input unit is a touch panel input device arranged to provide digital presentation of the set data.

15. A stretch wrapping machine according to claim 14, wherein the touch panel input device has a function of displaying a screen for selecting any one of a plurality of programs which are set and stored in advance.

16. A stretch wrapping machine according to claim 14, wherein the touch panel input device has a function of selectively displaying any one of a plurality of screens in response to a touch input, the screens including a setting screen for setting data on the number of rotations of the rotation mechanism, any one of a film overlap amount and a feed rate of the feed mechanism, and a film wrapping tension, an automatic operation screen for indicating a condition of an automatic operation and a manual operation screen for conducting a manual operation.

17. A stretch wrapping machine according to claim 6, 7 or 8, wherein the controller is arranged to monitor an occurrence of a machine failure, and, in the case of a failure, to indicate a failure point and failure details on a display of the touch panel input device.

18. A stretch wrapping machine according to claim 6, 7 or 8, wherein the controller is arranged to monitor an occurrence of a machine failure, and, in the case of a failure, to supply information on a failure point and failure details to an output unit, so that the failure information can be sent from the output unit to a person in charge of maintenance via a communication network.

* * * * *